US007216507B2

(12) United States Patent
Cuellar et al.

(10) Patent No.: US 7,216,507 B2
(45) Date of Patent: May 15, 2007

(54) LIQUEFIED NATURAL GAS PROCESSING

(75) Inventors: Kyle T. Cuellar, Katy, TX (US); John D. Wilkinson, Midland, TX (US); Hank M. Hudson, Midland, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 4 days.

(21) Appl. No.: 11/144,728

(22) Filed: Jun. 3, 2005

(65) Prior Publication Data

US 2006/0000234 A1 Jan. 5, 2006

Related U.S. Application Data

(60) Provisional application No. 60/671,930, filed on Apr. 15, 2005, provisional application No. 60/669,642, filed on Apr. 8, 2005, provisional application No. 60/646,903, filed on Jan. 24, 2005, provisional application No. 60/584,668, filed on Jul. 1, 2004.

(51) Int. Cl.
*F25J 3/00* (2006.01)

(52) U.S. Cl. ..... 62/620; 62/630

(58) Field of Classification Search ..... 62/620, 62/630, 625, 635

See application file for complete search history.

(56) References Cited

U.S. PATENT DOCUMENTS 2,603,310 A 7/1952 Gilmore ..... 62/25

(Continued)

FOREIGN PATENT DOCUMENTS

FR 1535846 A 8/1968

(Continued)

OTHER PUBLICATIONS

Huang et al., "Select the Optimum Extraction Method for LNG Regasification; Varying Energy Compositions of LNG Imports may Require Terminal Operators to Remove $C_2$+ Compounds before Injecting Regasified LNG into Pipelines", *Hydrocarbon Processing*, 83, 57-62, Jul. 2004.

(Continued)

*Primary Examiner*—William C. Doerrler
(74) *Attorney, Agent, or Firm*—Fitzpatrick, Cella, Harper & Scinto

(57) ABSTRACT

A process and apparatus for the recovery of ethane, ethylene, propane, propylene, and heavier hydrocarbons from a liquefied natural gas (LNG) stream is disclosed. The LNG feed stream is divided into two portions. The first portion is supplied to a fractionation column at an upper mid-column feed point. The second portion is directed in heat exchange relation with a warmer distillation stream rising from the fractionation stages of the column, whereby this portion of the LNG feed stream is partially heated and the distillation stream is totally condensed. The condensed distillation stream is divided into a "lean" LNG product stream and a reflux stream, whereupon the reflux stream is supplied to the column at a top column feed position. The partially heated portion of the LNG feed stream is heated further to partially or totally vaporize it and thereafter supplied to the column at a lower mid-column feed position. The quantities and temperatures of the feeds to the column are effective to maintain the column overhead temperature at a temperature whereby the major portion of the desired components is recovered in the bottom liquid product from the column.

67 Claims, 13 Drawing Sheets

U.S. PATENT DOCUMENTS

Figure 1:
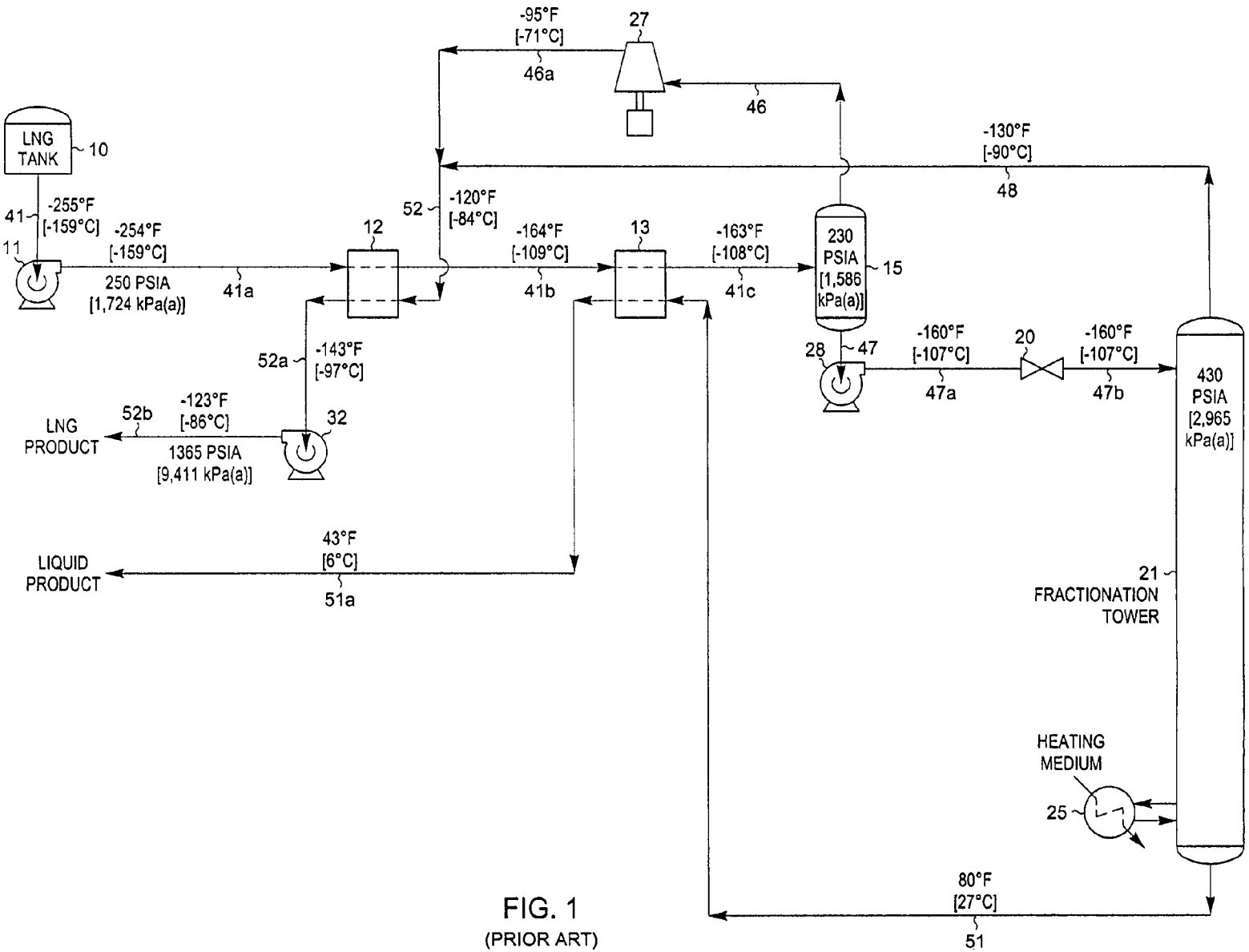
FIG. 1 (PRIOR ART)

| | | | | |
|---|---|---|---|---|
| 2,880,592 | A | 4/1959 | Davidson | 62/25 |
| 2,952,984 | A | 9/1960 | Marshall | 62/622 |
| 3,292,380 | A | 12/1966 | Bucklin | 62/20 |
| 3,724,226 | A | 4/1973 | Pachaly | 62/39 |
| 3,763,658 | A | 10/1973 | Gaumer | 62/40 |
| 3,837,172 | A | 9/1974 | Markbreiter et al. | 62/621 |
| 4,033,735 | A | 7/1977 | Swenson | 62/612 |
| 4,061,481 | A | 12/1977 | Campbell et al. | 62/621 |
| 4,065,278 | A | 12/1977 | Newton et al. | 62/622 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,368,061 | A | 1/1983 | Mestrallet et al. | 62/28 |
| 4,404,008 | A | 9/1983 | Rentler et al. | 62/612 |
| 4,430,103 | A | 2/1984 | Gray et al. | 62/620 |
| 4,445,916 | A | 5/1984 | Newton | 62/625 |
| 4,445,917 | A | 5/1984 | Chiu | 62/625 |
| 4,453,958 | A | 6/1984 | Gulsby et al. | 62/621 |
| 4,519,824 | A | 5/1985 | Huebel | 62/621 |
| 4,525,185 | A | 6/1985 | Newton | 62/612 |
| 4,545,795 | A | 10/1985 | Liu et al. | 62/613 |
| 4,592,766 | A | 6/1986 | Kumman et al. | 62/621 |
| 4,596,588 | A | 6/1986 | Cook | 62/621 |
| 4,600,421 | A | 7/1986 | Kummann | 62/621 |
| 4,617,039 | A | 10/1986 | Buck | 62/621 |
| 4,657,571 | A | 4/1987 | Gazzi | 62/27 |
| 4,676,812 | A | 6/1987 | Kummann | 62/24 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,698,081 | A | 10/1987 | Aghili | 62/24 |
| 4,707,170 | A | 11/1987 | Ayres et al. | 62/627 |
| 4,710,214 | A | 12/1987 | Sharma et al. | 62/621 |
| 4,711,651 | A | 12/1987 | Sharma et al. | 62/24 |
| 4,718,927 | A | 1/1988 | Bauer et al. | 62/24 |
| 4,720,294 | A | 1/1988 | Lucadamo et al. | 62/28 |
| 4,738,699 | A | 4/1988 | Apffel | 62/24 |
| 4,752,312 | A | 6/1988 | Prible | 62/25 |
| 4,755,200 | A | 7/1988 | Liu et al. | 62/612 |
| 4,793,841 | A | 12/1988 | Burr | 62/27 |
| 4,851,020 | A | 7/1989 | Montgomery, IV | 62/621 |
| 4,854,955 | A | 8/1989 | Campbell et al. | 62/621 |
| 4,869,740 | A | 9/1989 | Campbell et al. | 62/621 |
| 4,881,960 | A | 11/1989 | Ranke et al. | 62/27 |
| 4,889,545 | A | 12/1989 | Campbell et al. | 62/621 |
| 4,895,584 | A | 1/1990 | Buck et al. | 62/621 |
| RE33,408 | E | 10/1990 | Khan | 62/29 |
| 4,970,867 | A | 11/1990 | Herron et al. | 62/613 |
| 5,114,451 | A * | 5/1992 | Rambo et al. | 62/623 |
| 5,275,005 | A | 1/1994 | Campbell et al. | 62/621 |
| 5,291,736 | A | 3/1994 | Paradowski | 62/613 |
| 5,325,673 | A | 7/1994 | Durr et al. | 62/634 |
| 5,363,655 | A | 11/1994 | Kikkawa et al. | 62/613 |
| 5,365,740 | A | 11/1994 | Kikkawa et al. | 62/613 |
| 5,537,827 | A | 7/1996 | Low et al. | 62/613 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,669,234 | A | 9/1997 | Houser et al. | 62/612 |
| 5,737,940 | A | 4/1998 | Yao et al. | 62/620 |
| 5,755,114 | A | 5/1998 | Foglietta | 62/618 |
| 5,755,115 | A | 5/1998 | Manley | 62/620 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,893,274 | A | 4/1999 | Nagelvoort et al. | 62/613 |
| 5,950,453 | A | 9/1999 | Bowen et al. | 62/612 |
| 5,983,664 | A | 11/1999 | Campbell et al. | 62/621 |
| 6,014,869 | A | 1/2000 | Elion et al. | 62/621 |
| 6,016,665 | A | 1/2000 | Cole et al. | 62/612 |
| 6,023,942 | A | 2/2000 | Thomas et al. | 62/613 |
| 6,053,007 | A | 4/2000 | Victory et al. | 62/619 |
| 6,062,041 | A | 5/2000 | Kikkawa et al. | 62/613 |
| 6,116,050 | A | 9/2000 | Yao et al. | 62/630 |
| 6,119,479 | A | 9/2000 | Roberts et al. | 62/612 |
| 6,125,653 | A | 10/2000 | Shu et al. | 62/622 |
| 6,182,469 | B1 | 2/2001 | Campbell et al. | 62/621 |
| 6,250,105 | B1 | 6/2001 | Kimble | 62/613 |
| 6,269,655 | B1 | 8/2001 | Roberts et al. | 62/612 |
| 6,272,882 | B1 | 8/2001 | Hodges et al. | 62/613 |
| 6,308,531 | B1 | 10/2001 | Roberts et al. | 62/611 |
| 6,324,867 | B1 | 12/2001 | Fanning et al. | 62/613 |
| 6,336,344 | B1 | 1/2002 | O'Brien | 62/627 |
| 6,347,532 | B1 | 2/2002 | Agrawal et al. | 62/612 |
| 6,363,744 | B2 | 4/2002 | Finn et al. | 62/621 |
| 6,367,286 | B1 | 4/2002 | Price | 62/613 |
| 6,401,486 | B1 | 6/2002 | Lee et al. | 62/630 |
| 6,526,777 | B1 | 3/2003 | Campbell et al. | 62/621 |
| 6,604,380 | B1 | 8/2003 | Reddick et al. | 62/620 |
| 6,742,358 | B2 | 6/2004 | Wilkinson et al. | 62/613 |
| 6,907,752 | B2 | 6/2005 | Schroeder et al. | 62/620 |
| 6,941,771 | B2 | 9/2005 | Reddick et al. | 62/620 |
| 2003/0158458 | A1 | 8/2003 | Prim | 585/800 |
| 2004/0079107 | A1 | 4/2004 | Wilkinson et al. | 62/611 |
| 2005/0061029 | A1 | 3/2005 | Narinsky | 62/620 |
| 2005/0066686 | A1 * | 3/2005 | Wilkinson et al. | 62/620 |
| 2005/0155381 | A1 | 7/2005 | Yang et al. | 62/620 |

FOREIGN PATENT DOCUMENTS

| | | | |
|---|---|---|---|
| GB | 2102931 | | 2/1983 |
| RU | 1606828 | | 11/1990 |
| WO | 01/88447 | A1 | 11/2001 |
| WO | 2004/109180 | A | 12/2004 |
| WO | 2005/015100 | A | 2/2005 |
| WO | 2005/035692 | A | 4/2005 |

OTHER PUBLICATIONS

Yang et al., "Cost-Effective Design Reduces $C_2$ and $C_3$ at LNG Receiving Terminals", *Oil & Gas Journal*, 50-53, May 26, 2003.

U.S. Appl. No. 09/677,220, filed Oct. 2000, Wilkinson et al.

Finn, Adrian J., Grant L. Johnson, and Terry R. Tomilson, "LNG Technology for Offshore and Mid-Scale Plants", Proceedings of the Seventy-Ninth Annual Convention of the Gas Processors Association, pp. 429-450, Atlanta, Georgia, Mar. 13-15, 2000.

Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonia, Texas, Mar.12-14, 2001.

Price, Brian C., "LNG Production for Peak Shaving Operations", Proceedings of the Seventy-Eighth Annual Convention of the Gas Processors Association, pp. 273-280, Nashville, Tennessee, Mar. 1-3, 1999.

* cited by examiner

LIQUEFIED NATURAL GAS PROCESSING

BACKGROUND OF THE INVENTION

This invention relates to a process for the separation of ethane and heavier hydrocarbons or propane and heavier hydrocarbons from liquefied natural gas, hereinafter referred to as LNG, to provide a volatile methane-rich lean LNG stream and a less volatile natural gas liquids (NGL) or liquefied petroleum gas (LPG) stream. The applicants claim the benefits under Title 35, United States Code, Section 119(e) of prior U.S. Provisional Application Nos. 60/584,668 which was filed on Jul. 1, 2004, 60/646,903 which was filed on Jan. 24, 2005, Ser. No. 60/669,642 which was filed on Apr. 8, 2005, and Ser. No. 60/671,930 which was filed on Apr. 15, 2005.

As an alternative to transportation in pipelines, natural gas at remote locations is sometimes liquefied and transported in special LNG tankers to appropriate LNG receiving and storage terminals. The LNG can then be re-vaporized and used as a gaseous fuel in the same fashion as natural gas. Although LNG usually has a major proportion of methane, i.e., methane comprises at least 50 mole percent of the LNG, it also contains relatively lesser amounts of heavier hydrocarbons such as ethane, propane, butanes, and the like, as well as nitrogen. It is often necessary to separate some or all of the heavier hydrocarbons from the methane in the LNG so that the gaseous fuel resulting from vaporizing the LNG conforms to pipeline specifications for heating value. In addition, it is often also desirable to separate the heavier hydrocarbons from the methane because these hydrocarbons have a higher value as liquid products (for use as petrochemical feedstocks, as an example) than their value as fuel.

Although there are many processes which may be used to separate ethane and heavier hydrocarbons from LNG, these processes often must compromise between high recovery, low utility costs, and process simplicity (and hence low capital investment). U.S. Pat. Nos. 2,952,984; 3,837,172; and 5,114,451 and co-pending application Ser. No. 10/675,785 describe relevant LNG processes capable of ethane or propane recovery while producing the lean LNG as a vapor stream that is thereafter compressed to delivery pressure to enter a gas distribution network. However, lower utility costs may be possible if the lean LNG is instead produced as a liquid stream that can be pumped (rather than compressed) to the delivery pressure of the gas distribution network, with the lean LNG subsequently vaporized using a low level source of external heat or other means. U.S. Patent Application Publication No. US 2003/0158458 A1 describes such a process.

The present invention is generally concerned with the recovery of ethylene, ethane, propylene, propane, and heavier hydrocarbons from such LNG streams. It uses a novel process arrangement to allow high ethane or high propane recovery while keeping the processing equipment simple and the capital investment low. Further, the present invention offers a reduction in the utilities (power and heat) required to process the LNG to give lower operating cost than the prior art processes. A typical analysis of an LNG stream to be processed in accordance with this invention would be, in approximate mole percent, 86.7% methane, 8.9% ethane and other $C_2$ components, 2.9% propane and other $C_3$ components, and 1.0% butanes plus, with the balance made up of nitrogen.

Figure 2:
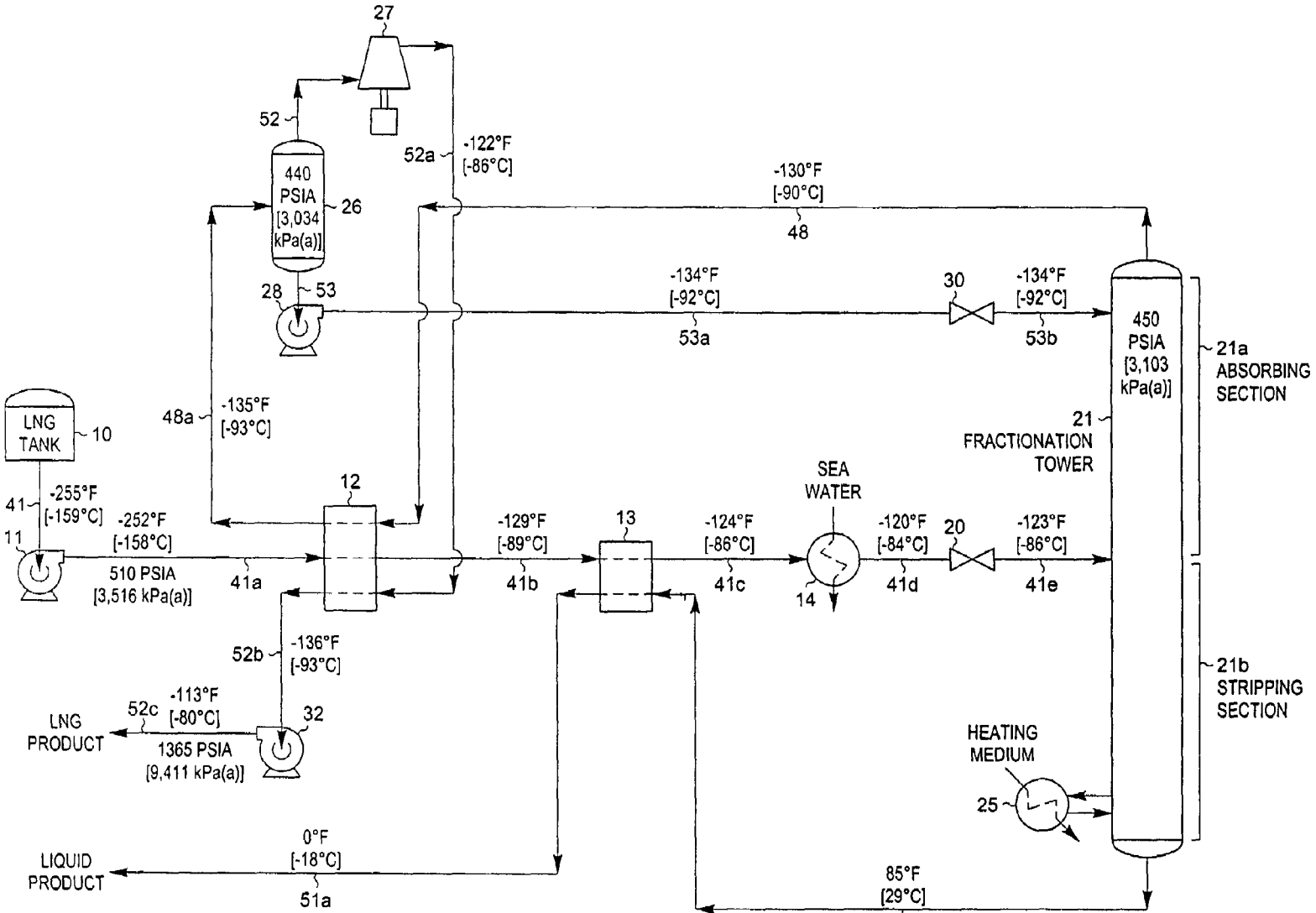
FIG. 2 (PRIOR ART)
Figure 3:
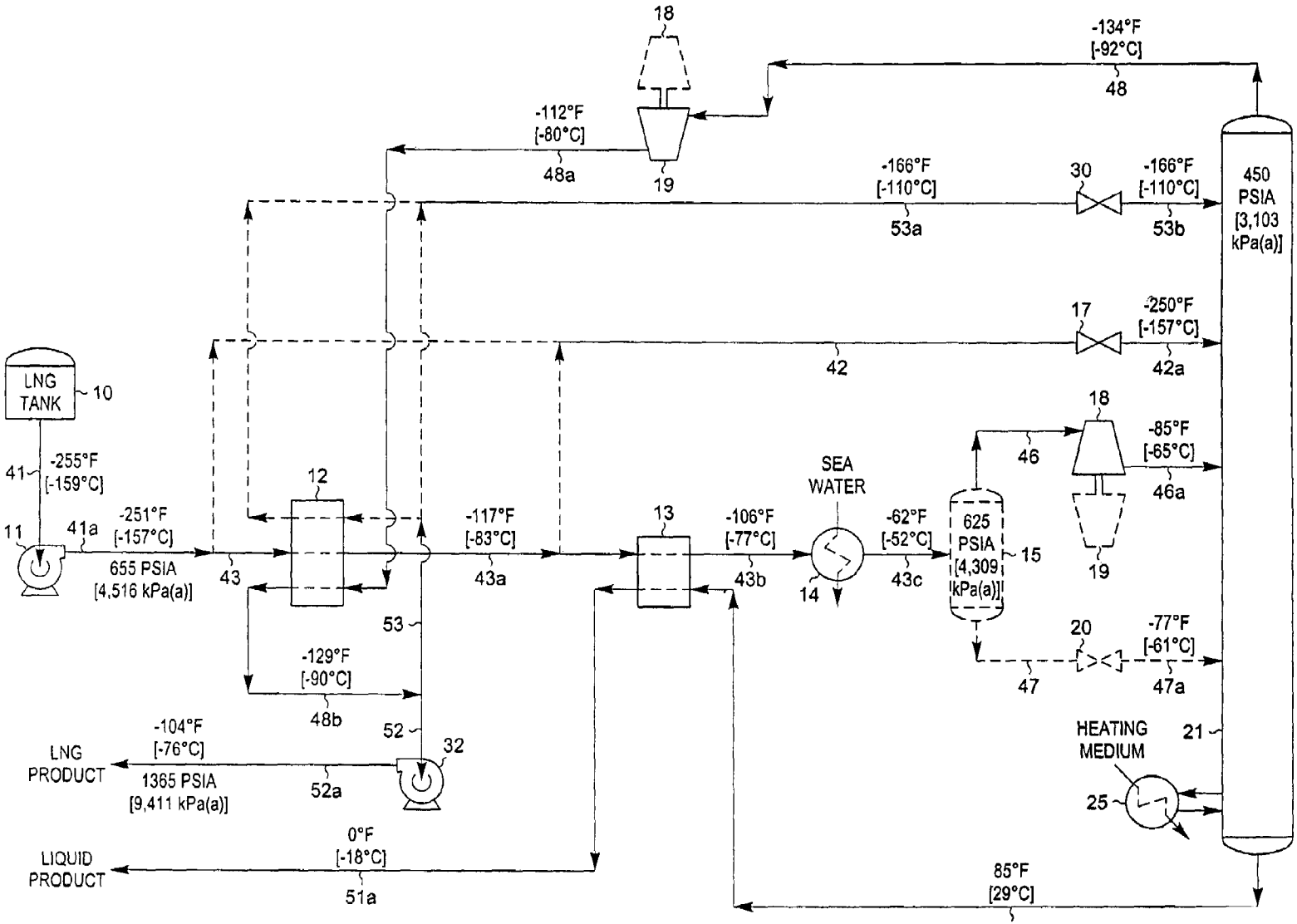

For a better understanding of the present invention, reference is made to the following examples and drawings. Referring to the drawings:

FIG. 1 is a flow diagrams of a prior art LNG processing plant;

FIG. 2 is a flow diagram of a prior art LNG processing plant in accordance with U.S. Patent Application Publication No. US 2003/0158458 A1;

FIG. 3 is a flow diagram of an LNG processing plant in accordance with the present invention; and FIGS. 4 through 13 are flow diagrams illustrating alternative means of application of the present invention to an LNG processing plant.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Referring now to FIG. 1, for comparison purposes we begin with an example of a prior art LNG processing plant adapted to produce an NGL product containing the majority of the $C_2$ components and heavier hydrocarbon components present in the feed stream. The LNG to be processed (stream 41) from LNG tank 10 enters pump 11 at −255° F. [−159° C.]. Pump 11 elevates the pressure of the LNG sufficiently so that it can flow through heat exchangers and thence to separator 15. Stream 41*a* exiting the pump is heated in heat exchangers 12 and 13 by heat exchange with gas stream 52 at −120° F. [−84° C.] and demethanizer bottom liquid product (stream 51) at 80° F. [27° C.].

The heated stream 41*c* enters separator 15 at −163° F. [−108° C.] and 230 psia [1,586 kPa(a)] where the vapor (stream 46) is separated from the remaining liquid (stream 47). Stream 47 is pumped by pump 28 to higher pressure, then expanded to the operating pressure (approximately 430 psia [2,965 kPa(a)]) of fractionation tower 21 by control valve 20 and supplied to the tower as the top column feed (stream 47*b*).

Fractionation column or tower 21, commonly referred to as a demethanizer, is a conventional distillation column containing a plurality of vertically spaced trays, one or more packed beds, or some combination of trays and packing. The trays and/or packing provide the necessary contact between the liquids falling downward in the column and the vapors rising upward. The column also includes one or more reboilers (such as reboiler 25) which heat and vaporize a portion of the liquids flowing down the column to provide the stripping vapors which flow up the column. These vapors strip the methane from the liquids, so that the bottom liquid product (stream 51) is substantially devoid of methane and comprised of the majority of the $C_2$ components and heavier hydrocarbons contained in the LNG feed stream. (Because of the temperature level required in the column reboiler, a high level source of utility heat is typically required to provide the heat input to the reboiler, such as the heating medium used in this example.) The liquid product stream 51 exits the bottom of the tower at 80° F. [27° C.], based on a typical specification of a methane fraction of 0.005 on a volume basis in the bottom product. After cooling to 43° F. [6° C.] in heat exchanger 13 as described previously, the liquid product (stream 51*a*) flows to storage or further processing.

Vapor stream 46 from separator 15 enters compressor 27 (driven by an external power source) and is compressed to higher pressure. The resulting stream 46*a* is combined with the demethanizer overhead vapor, stream 48, leaving demethanizer 21 at −130° F. [−90° C.] to produce a methane-rich residue gas (stream 52) at −120° F. [−84° C.], which is thereafter cooled to −143° F. [−97° C.] in heat exchanger 12 as described previously to totally condense the stream. Pump 32 then pumps the condensed liquid (stream 52*a*) to 1365 psia [9,411 kPa(a)] (stream 52*b*) for subsequent vaporization and/or transportation.

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 46 | 3,253 | 20 | 1 | 0 | 3,309 |
| 47 | 6,271 | 957 | 321 | 109 | 7,670 |
| 48 | 6,260 | 78 | 5 | 0 | 6,355 |
| 52 | 9,513 | 98 | 6 | 0 | 9,664 |
| 51 | 11 | 879 | 316 | 109 | 1,315 |

Recoveries*

| | |
|---|---|
| Ethane | 90.00% |
| Propane | 98.33% |
| Butanes+ | 99.62% |

Power

| | | |
|---|---|---|
| LNG Feed Pump | 123 HP | [202 kW] |
| Demethanizer Feed Pump | 132 HP | [217 kW] |
| LNG Product Pump | 773 HP | [1,271 kW] |
| Vapor Compressor | 527 HP | [867 kW] |
| Totals | 1,555 HP | [2,557 kW] |
| High Level Utility Heat | | |
| Demethanizer Reboiler | 23,271 MBTU/Hr | [15,032 kW] |

*(Based on un-rounded flow rates)

FIG. 2 shows an alternative prior art process in accordance with U.S. Patent Application Publication No. US 2003/0158458 A1 that can achieve somewhat higher recovery levels with lower utility consumption than the prior art process used in FIG. 1. The process of FIG. 2, adapted here to produce an NGL product containing the majority of the $C_2$ components and heavier hydrocarbon components present in the feed stream, has been applied to the same LNG composition and conditions as described previously for FIG. 1.

In the simulation of the FIG. 2 process, the LNG to be processed (stream 41) from LNG tank 10 enters pump 11 at −255° F. [−159° C.]. Pump 11 elevates the pressure of the LNG sufficiently so that it can flow through heat exchangers and thence to fractionation tower 21. Stream 41*a* exiting the pump is heated in heat exchangers 12 and 13 by heat exchange with column overhead vapor stream 48 at −130° F. [−90° C.], compressed vapor stream 52*a* at −122° F. [−86° C.], and demethanizer bottom liquid product (stream 51) at 85° F. [29° C.]. The partially heated stream 41*c* is then further heated to −120° F. [−84° C.] (stream 41*d*) in heat exchanger 14 using low level utility heat. (High level utility heat is normally more expensive than low level utility heat, so lower operating cost is usually achieved when the use of low level heat, such as the sea water used in this example, is maximized and the use of high level heat is minimized.) After expansion to the operating pressure (approximately 450 psia [3,103 kPa(a)]) of fractionation tower 21 by control valve 20, stream 41*e* flows to a mid-column feed point at −123° F. [−86° C.].

The demethanizer in tower 21 is a conventional distillation column containing a plurality of vertically spaced trays, one or more packed beds, or some combination of trays and packing. As is often the case in natural gas processing plants, the fractionation tower may consist of two sections. The upper absorbing (rectification) section 21*a* contains the trays and/or packing to provide the necessary contact between the vapors rising upward and cold liquid falling downward to condense and absorb the ethane and heavier components; the lower stripping (demethanizing) section 21*b* contains the trays and/or packing to provide the necessary contact between the liquids falling downward and the vapors rising upward. The demethanizing section also includes one or more reboilers (such as reboiler 25) which heat and vaporize a portion of the liquids flowing down the column to provide the stripping vapors which flow up the column. These vapors strip the methane from the liquids, so that the bottom liquid product (stream 51) is substantially devoid of methane and comprised of the majority of the $C_2$ components and heavier hydrocarbons contained in the LNG feed stream.

Overhead stream 48 leaves the upper section of fractionation tower 21 at −130° F. [−90° C.] and flows to heat exchanger 12 where it is cooled to −135° F. [−93° C.] and partially condensed by heat exchange with the cold LNG (stream 41*a*) as described previously. The partially condensed stream 48*a* enters reflux separator 26 wherein the condensed liquid (stream 53) is separated from the uncondensed vapor (stream 52). The liquid stream 53 from reflux separator 26 is pumped by reflux pump 28 to a pressure slightly above the operating pressure of demethanizer 21 and stream 53*b* is then supplied as cold top column feed (reflux) to demethanizer 21 by control valve 30. This cold liquid reflux absorbs and condenses the $C_2$ components and heavier hydrocarbon components from the vapors rising in the upper absorbing (rectification) section 21*a* of demethanizer 21.

The liquid product stream 51 exits the bottom of fractionation tower 21 at 85° F. [29° C.], based on a methane fraction of 0.005 on a volume basis in the bottom product. After cooling to 0° F. [−18° C.] in heat exchanger 13 as described previously, the liquid product (stream 51*a*) flows to storage or further processing. The methane-rich residue gas (stream 52) leaving reflux separator 26 is compressed to 493 psia [3,400 kPa(a)] (stream 52*a*) by compressor 27

(driven by an external power source), so that the stream can be totally condensed as it is cooled to −136° F. [−93° C.] in heat exchanger 12 as described previously. Pump 32 then pumps the condensed liquid (stream 52*b*) to 1365 psia [9,411 kPa(a)] (stream 52*c*) for subsequent vaporization and/or transportation.

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 48 | 10,540 | 177 | 0 | 0 | 10,766 |
| 53 | 1,027 | 79 | 0 | 0 | 1,108 |
| 52 | 9,513 | 98 | 0 | 0 | 9,658 |
| 51 | 11 | 879 | 322 | 109 | 1,321 |

Recoveries*

| | |
|---|---|
| Ethane | 90.01% |
| Propane | 100.00% |
| Butanes+ | 100.00% |

| | Power | |
|---|---|---|
| LNG Feed Pump | 298 HP | [490 kW] |
| Reflux Pump | 5 HP | [8 kW] |
| LNG Product Pump | 762 HP | [1,253 kW] |
| Vapor Compressor | 226 HP | [371 kW] |
| Totals | 1,291 HP | [2,122 kW] |
| | Low Level Utility Heat | |
| LNG Heater | 6,460 MBTU/Hr | [4,173 kW] |
| | High Level Utility Heat | |
| Demethanizer Reboiler | 17,968 MBTU/Hr | [11,606 kW] |

*(Based on un-rounded flow rates)

Comparing the recovery levels displayed in Table II above for the FIG. 2 prior art process with those in Table I for the FIG. 1 prior art process shows that the FIG. 2 process can achieve essentially the same ethane recovery and slightly higher propane and butanes+ recoveries. Comparing the utilities consumptions in Table II with those in Table I shows that the FIG. 2 process requires less power and less high level utility heat than the FIG. 1 process. The reduction in power is achieved through the use of reflux for demethanizer 21 in the FIG. 2 process to provide more efficient recovery of the ethane and heavier components in the tower. This in turn allows for a higher tower feed temperature than the FIG. 1 process, reducing the reboiler heating requirements in demethanizer 21 (which uses high level utility heat) through the use of low level utility heat in heat exchanger 14 to heat the tower feed. (Note that the FIG. 1 process cools bottom product stream 51*a* to 43° F. [6° C.], versus the desired 0° F. [−18° C.] for the FIG. 2 process. For the FIG. 1 process, attempting to cool stream 51*a* to a lower temperature does reduce the high level utility heat requirement of reboiler 25, but the resulting higher temperature for stream 41*c* entering separator 15 causes the power usage of vapor compressor 27 to increase disproportionately, because the operating pressure of separator 15 must be lowered if the same recovery efficiencies are to be maintained.)

DESCRIPTION OF THE INVENTION

EXAMPLE 1

FIG. 3 illustrates a flow diagram of a process in accordance with the present invention. The LNG composition and conditions considered in the process presented in FIG. 3 are the same as those in FIGS. 1 and 2. Accordingly, the FIG. 3 process can be compared with that of the FIGS. 1 and 2 processes to illustrate the advantages of the present invention.

In the simulation of the FIG. 3 process, the LNG to be processed (stream 41) from LNG tank 10 enters pump 11 at −255° F. [−159° C.]. Pump 11 elevates the pressure of the LNG sufficiently so that it can flow through heat exchangers and thence to separator 15. Stream 41*a* exiting the pump is split into two portions, streams 42 and 43. The first portion, stream 42, is expanded to the operating pressure (approximately 450 psia [3,103 kPa(a)]) of fractionation column 21 by expansion valve 17 and supplied to the tower at an upper mid-column feed point. The second portion, stream 43, is heated prior to entering separator 15 so that all or a portion of it is vaporized. In the example shown in FIG. 3, stream 43 is first heated to −106° F. [−77° C.] in heat exchangers 12 and 13 by cooling compressed overhead vapor stream 48*a* at −112° F. [−80° C.], reflux stream 53 at −129° F. [−90° C.], and the liquid product from the column (stream 51) at 85° F. [29° C.]. The partially heated stream 43*b* is then further heated (stream 43*c*) in heat exchanger 14 using low level utility heat. Note that in all cases exchangers 12, 13, and 14 are representative of either a multitude of individual heat exchangers or a single multi-pass heat exchanger, or any combination thereof. (The decision as to whether to use more than one heat exchanger for the indicated heating services will depend on a number of factors including, but not limited to, inlet LNG flow rate, heat exchanger size, stream temperatures, etc.)

The heated stream 43*c* enters separator 15 at −62° F. [−52° C.] and 625 psia [4,309 kPa(a)] where the vapor (stream 46) is separated from any remaining liquid (stream 47). The vapor from separator 15 (stream 46) enters a work expansion machine 18 in which mechanical energy is extracted from this portion of the high pressure feed. The machine 18 expands the vapor substantially isentropically to the tower operating pressure, with the work expansion cooling the expanded stream 46*a* to a temperature of approximately −85° F. [−65° C.]. The typical commercially available expanders are capable of recovering on the order of 80–88% of the work theoretically available in an ideal isentropic expansion. The work recovered is often used to drive a centrifugal compressor (such as item 19) that can be used to re-compress the column overhead vapor (stream 48), for example. The partially condensed expanded stream 46*a* is thereafter supplied as feed to fractionation column 21 at a mid-column feed point. The separator liquid (stream 47) is expanded to the operating pressure of fractionation column 21 by expansion valve 20, cooling stream 47*a* to −77° F. [−61° C.] before it is supplied to fractionation tower 21 at a lower mid-column feed point.

The demethanizer in fractionation column 21 is a conventional distillation column containing a plurality of vertically spaced trays, one or more packed beds, or some combination of trays and packing. Similar to the fractionation tower shown in FIG. 2, the fractionation tower in FIG. 3 may consist of two sections. The upper absorbing (rectification) section contains the trays and/or packing to provide the necessary contact between the vapors rising upward and cold liquid falling downward to condense and absorb the ethane and heavier components; the lower stripping (demethanizing) section contains the trays and/or packing to provide the necessary contact between the liquids falling downward and the vapors rising upward. The demethanizing section also includes one or more reboilers (such as reboiler 25) which heat and vaporize a portion of the liquids flowing down the column to provide the stripping vapors which flow up the column. The liquid product stream 51 exits the bottom of the tower at 85° F. [29° C.], based on a methane fraction of 0.005 on a volume basis in the bottom product. After cooling to 0° F. [−18° C.] in heat exchanger 13 as described previously, the liquid product (stream 51*a*) flows to storage or further processing.

Overhead distillation stream 48 is withdrawn from the upper section of fractionation tower 21 at −134° F. [−92° C.] and flows to compressor 19 driven by expansion machine 18, where it is compressed to 550 psia [3,789 kPa(a)] (stream 48*a*). At this pressure, the stream is totally condensed as it is cooled to −129° F. [−90° C.] in heat exchanger 12 as described previously. The condensed liquid (stream 48*b*) is then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which flows to heat exchanger 12 where it is subcooled to −166° F. [−110° C.] by heat exchange with a portion of the cold LNG (stream 43) as described previously. The subcooled reflux stream 53*a* is expanded to the operating pressure of demethanizer 21 by expansion valve 30 and the expanded stream 53*b* is then supplied as cold top column feed (reflux) to demethanizer 21. This cold liquid reflux absorbs and condenses the $C_2$ components and heavier hydrocarbon components from the vapors rising in the upper rectification section of demethanizer 21.

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 1,743 | 179 | 59 | 20 | 2,009 |
| 43 | 7,781 | 798 | 263 | 89 | 8,970 |
| 46 | 7,291 | 554 | 96 | 14 | 7,993 |
| 47 | 490 | 244 | 167 | 75 | 977 |
| 48 | 10,318 | 105 | 0 | 0 | 10,474 |
| 53 | 805 | 8 | 0 | 0 | 817 |
| 52 | 9,513 | 97 | 0 | 0 | 9,657 |
| 51 | 11 | 880 | 322 | 109 | 1,322 |

Recoveries*

| | |
|---|---|
| Ethane | 90.05% |
| Propane | 99.89% |
| Butanes+ | 100.00% |

| | Power | |
|---|---|---|
| LNG Feed Pump | 396 HP | [651 kW] |
| LNG Product Pump | 756 HP | [1,243 kW] |
| Totals | 1,152 HP | [1,894 kW] |
| | Low Level Utility Heat | |
| LNG Heater | 18,077 MBTU/Hr | [11,677 kW] |
| | High Level Utility Heat | |
| Demethanizer Reboiler | 8,441 MBTU/Hr | [5,452 kW] |

*(Based on un-rounded flow rates)

Comparing the recovery levels displayed in Table III above for the FIG. 3 process with those in Table I for the FIG. 1 prior art process shows that the present invention matches the ethane recovery and achieves slightly higher propane recovery (99.89% versus 98.33%) and butanes+ recovery (100.00% versus 99.62%) of the FIG. 1 process. However, comparing the utilities consumptions in Table III with those in Table I shows that both the power required and the high level utility heat required for the present invention are much lower than for the FIG. 1 process (26% lower and 64% lower, respectively).

Comparing the recovery levels displayed in Table III with those in Table II for the FIG. 2 prior art process shows that the present invention essentially matches the liquids recovery of the FIG. 2 process. (Only the propane recovery is slightly lower, 99.89% versus 100.00%.) However, comparing the utilities consumptions in Table III with those in Table II shows that both the power required and the high level utility heat required for the present invention are significantly lower than for the FIG. 2 process (11% lower and 53% lower, respectively).

There are three primary factors that account for the improved efficiency of the present invention. First, compared to the FIG. 1 prior art process, the present invention does not depend on the LNG feed itself to directly serve as the reflux for fractionation column 21. Rather, the refrigeration inherent in the cold LNG is used in heat exchanger 12 to generate a liquid reflux stream (stream 53) that contains very little of the $C_2$ components and heavier hydrocarbon components that are to be recovered, resulting in efficient rectification in the upper absorbing section of fractionation tower 21 and avoiding the equilibrium limitations of the prior art FIG. 1 process. Second, compared to the FIGS. 1 and 2 prior art processes, splitting the LNG feed into two portions before feeding fractionation column 21 allows more efficient use of low level utility heat, thereby reducing the amount of high level utility heat consumed by reboiler 25. The relatively colder portion of the LNG feed (stream 42*a* in FIG. 3) serves as a supplemental reflux stream for fractionation tower 21, providing partial rectification of the vapors in the expanded vapor and liquid streams (streams 46*a* and 47*a* in FIG. 3) so that heating and partially vaporizing this portion (stream 43) of the LNG feed does not unduly increase the condensing load in heat exchanger 12. Third, compared to the FIG. 2 prior art process, using a portion of the cold LNG feed (stream 42*a* in FIG. 3) as a supplemental reflux stream allows using less top reflux for fractionation tower 21, as can be seen by comparing stream 53 in Table III with stream 53 in Table II. The lower top reflux flow, plus the greater degree of heating using low level utility heat in heat exchanger 14 (as seen by comparing Table III with Table II), results in less total liquid feeding fractionation column 21, reducing the duty required in reboiler 25 and minimizing the amount of high level utility heat needed to meet the specification for the bottom liquid product from the demethanizer.

EXAMPLE 2

Figure 4:
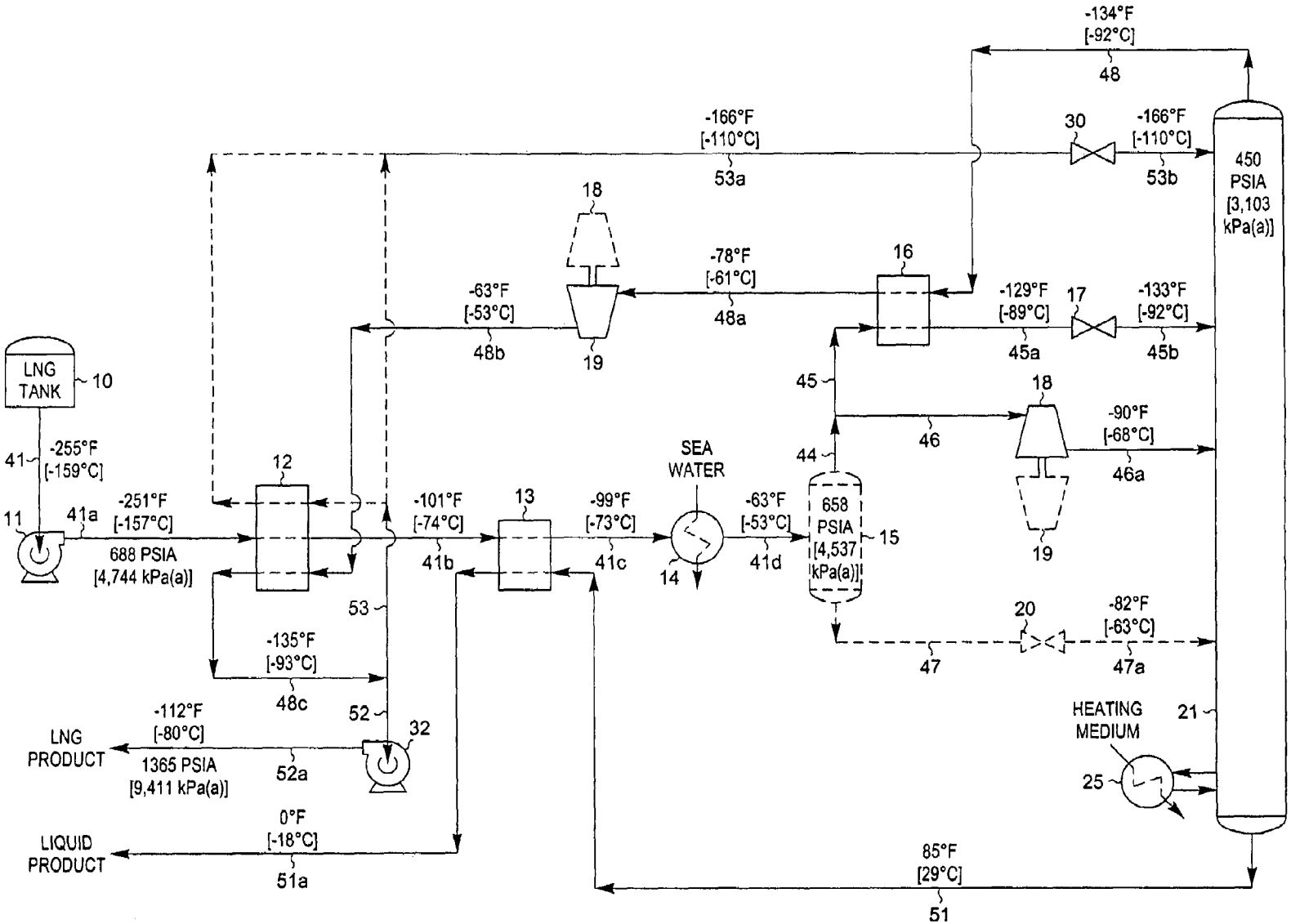

An alternative embodiment of the present invention is shown in FIG. 4. The LNG composition and conditions considered in the process presented in FIG. 4 are the same as those in FIG. 3, as well as those described previously for FIGS. 1 and 2. Accordingly, the FIG. 4 process of the present invention can be compared to the embodiment displayed in FIG. 3 and to the prior art processes displayed in FIGS. 1 and 2.

In the simulation of the FIG. 4 process, the LNG to be processed (stream 41) from LNG tank 10 enters pump 11 at −255° F. [−159° C.]. Pump 11 elevates the pressure of the LNG sufficiently so that it can flow through heat exchangers and thence to separator 15. Stream 41*a* exiting the pump is heated prior to entering separator 15 so that all or a portion of it is vaporized. In the example shown in FIG. 4, stream 41*a* is first heated to −99° F. [−73° C.] in heat exchangers 12 and 13 by cooling compressed overhead vapor stream 48*b* at −63° F. [−53° C.], reflux stream 53 at −135° F. [−93° C.], and the liquid product from the column (stream 51) at 85° F. [29° C.]. The partially heated stream 41*c* is then further heated (stream 41*d*) in heat exchanger 14 using low level utility heat.

The heated stream 41*d* enters separator 15 at −63° F. [−53° C.] and 658 psia [4,537 kPa(a)] where the vapor (stream 44) is separated from any remaining liquid (stream 47). The separator liquid (stream 47) is expanded to the operating pressure (approximately 450 psia [3,103 kPa(a)]) of fractionation column 21 by expansion valve 20, cooling stream 47*a* to −82° F. [−63° C.] before it is supplied to fractionation tower 21 at a lower mid-column feed point.

The vapor (stream 44) from separator 15 is divided into two streams, 45 and 46. Stream 45, containing about 30% of the total vapor, passes through heat exchanger 16 in heat exchange relation with the cold demethanizer overhead vapor at −134° F. [−92° C.] (stream 48) where it is cooled to substantial condensation. The resulting substantially condensed stream 45*a* at −129° F. [−89° C.] is then flash expanded through expansion valve 17 to the operating pressure of fractionation tower 21. During expansion a portion of the stream is vaporized, resulting in cooling of the total stream. In the process illustrated in FIG. 4, the expanded stream 45*b* leaving expansion valve 17 reaches a temperature of −133° F. [−92° C.] and is supplied to fractionation tower 21 at an upper mid-column feed point.

The remaining 70% of the vapor from separator 15 (stream 46) enters a work expansion machine 18 in which mechanical energy is extracted from this portion of the high pressure feed. The machine 18 expands the vapor substantially isentropically to the tower operating pressure, with the work expansion cooling the expanded stream 46*a* to a temperature of approximately −90° F. [−68° C.]. The partially condensed expanded stream 46*a* is thereafter supplied as feed to fractionation column 21 at a mid-column feed point.

The liquid product stream 51 exits the bottom of the tower at 85° F. [29° C.], based on a methane fraction of 0.005 on a volume basis in the bottom product. After cooling to 0° F. [−18° C.] in heat exchanger 13 as described previously, the liquid product (stream 51*a*) flows to storage or further processing.

Overhead distillation stream 48 is withdrawn from the upper section of fractionation tower 21 at −134° F. [−92° C.] and passes countercurrently to the incoming feed gas in heat exchanger 16 where it is heated to −78° F. [−61° C.]. The heated stream 48*a* flows to compressor 19 driven by expansion machine 18, where it is compressed to 498 psia [3,430 kPa(a)] (stream 48*b*). At this pressure, the stream is totally condensed as it is cooled to −135° F. [−93° C.] in heat exchanger 12 as described previously. The condensed liquid (stream 48*c*) is then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which flows to heat exchanger 12 where it is subcooled to −166° F. [−110° C.] by heat exchange with the cold LNG (stream 41*a*) as described previously. The subcooled reflux stream 53*a* is expanded to the operating pressure of demethanizer 21 by expansion valve 30 and the expanded stream 53*b* is then supplied as cold top column feed (reflux) to demethanizer 21. This cold liquid reflux absorbs and condenses the $C_2$ components and heavier hydrocarbon components from the vapors rising in the upper rectification section of demethanizer 21.

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 44 | 8,789 | 647 | 111 | 16 | 9,609 |
| 47 | 735 | 330 | 211 | 93 | 1,370 |
| 45 | 2,663 | 196 | 34 | 5 | 2,911 |
| 46 | 6,126 | 451 | 77 | 11 | 6,698 |
| 48 | 10,547 | 108 | 0 | 0 | 10,706 |
| 53 | 1,034 | 11 | 0 | 0 | 1,049 |
| 52 | 9,513 | 97 | 0 | 0 | 9,657 |
| 51 | 11 | 880 | 322 | 109 | 1,322 |

Recoveries*

| | |
|---|---|
| Ethane | 90.06% |
| Propane | 99.96% |
| Butanes+ | 100.00% |

Power

| | | |
|---|---|---|
| LNG Feed Pump | 419 HP | [688 kW] |
| LNG Product Pump | 761 HP | [1,252 kW] |
| Totals | 1,180 HP | [1,940 kW] |
| | Low Level Utility Heat | |
| LNG Heater | 16,119 MBTU/Hr | [10,412 kW] |
| | High Level Utility Heat | |
| Demethanizer Reboiler | 8,738 MBTU/Hr | [5,644 kW] |

*(Based on un-rounded flow rates)

Comparing Table IV above for the FIG. 4 embodiment of the present invention with Table III for the FIG. 3 embodiment of the present invention shows that the liquids recovery is essentially the same for the FIG. 4 embodiment. Since the FIG. 4 embodiment uses the tower overhead (stream 48) to generate the supplemental reflux (stream 45*b*) for fractionation column 21 by condensing and subcooling a portion of the separator 15 vapor (stream 45) in heat exchanger 16, the gas entering compressor 19 (stream 48*a*) is considerably warmer than the corresponding stream in the FIG. 3 embodiment (stream 48). Depending on the type of compression equipment used in this service, the warmer temperature may offer advantages in terms of metallurgy, etc. However, since supplemental reflux stream 45*b* supplied to fractionation column 21 is not as cold as stream 42*a* in the FIG. 3 embodiment, more top reflux (stream 53*b*) is required and less low level utility heating can be used in heat exchanger 14. This increases the load on reboiler 25 and increases the amount of high level utility heat required by the FIG. 4 embodiment of the present invention compared to the FIG. 3 embodiment. The higher top reflux flow rate also increases the power requirements of the FIG. 4 embodiment slightly (by about 2%) compared to the FIG. 3 embodiment. The choice of which embodiment to use for a particular application will generally be dictated by the relative costs of power and high level utility heat and the relative capital costs of pumps, heat exchangers, and compressors.

EXAMPLE 3

Figure 5:
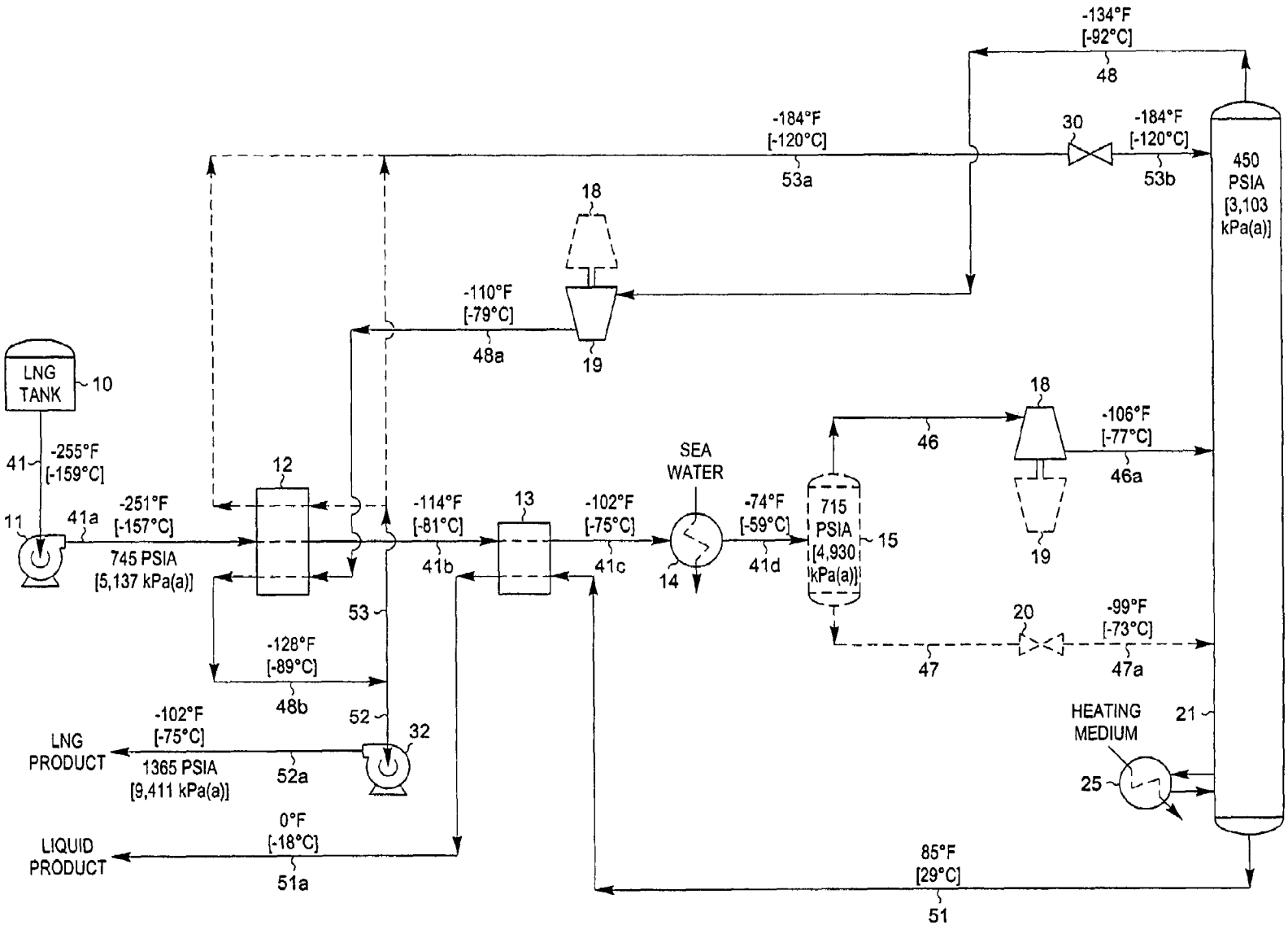

A simpler alternative embodiment of the present invention is shown in FIG. 5. The LNG composition and conditions considered in the process presented in FIG. 5 are the same as those in FIGS. 3 and 4, as well as those described previously for FIGS. 1 and 2. Accordingly, the FIG. 5 process of the present invention can be compared to the embodiments displayed in FIGS. 3 and 4 and to the prior art processes displayed in FIGS. 1 and 2.

In the simulation of the FIG. 5 process, the LNG to be processed (stream 41) from LNG tank 10 enters pump 11 at −255° F. [−159° C.]. Pump 11 elevates the pressure of the LNG sufficiently so that it can flow through heat exchangers and thence to separator 15. Stream 41*a* exiting the pump is heated prior to entering separator 15 so that all or a portion of it is vaporized. In the example shown in FIG. 5, stream 41*a* is first heated to −102° F. [−75° C.] in heat exchangers 12 and 13 by cooling compressed overhead vapor stream 48*a* at −110° F. [−79° C.], reflux stream 53 at −128° F. [−89° C.], and the liquid product from the column (stream 51) at 85° F. [29° C.]. The partially heated stream 41*c* is then further heated (stream 41*d*) in heat exchanger 14 using low level utility heat.

The heated stream 41*d* enters separator 15 at −74° F. [−59° C.] and 715 psia [4,930 kPa(a)] where the vapor (stream 46) is separated from any remaining liquid (stream 47). The separator vapor (stream 46) enters a work expansion machine 18 in which mechanical energy is extracted from this portion of the high pressure feed. The machine 18 expands the vapor substantially isentropically to the tower operating pressure (approximately 450 psia [3,103 kPa(a)]), with the work expansion cooling the expanded stream 46*a* to a temperature of approximately −106° F. [−77° C.]. The partially condensed expanded stream 46*a* is thereafter supplied as feed to fractionation column 21 at a mid-column feed point. The separator liquid (stream 47) is expanded to the operating pressure of fractionation tower 21 by expansion valve 20, cooling stream 47*a* to −99° F. [−73° C.] before it is supplied to fractionation column 21 at a lower mid-column feed point.

The liquid product stream 51 exits the bottom of the tower at 85° F. [29° C.], based on a methane fraction of 0.005 on a volume basis in the bottom product. After cooling to 0° F. [−18° C.] in heat exchanger 13 as described previously, the liquid product (stream 51*a*) flows to storage or further processing.

Overhead distillation stream 48 is withdrawn from the upper section of fractionation tower 21 at −134° F. [−92° C.] and flows to compressor 19 driven by expansion machine 18, where it is compressed to 563 psia [3,882 kPa(a)] (stream 48*a*). At this pressure, the stream is totally condensed as it is cooled to −128° F. [−89° C.] in heat exchanger 12 as described previously. The condensed liquid (stream 48*b*) is then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which flows to heat exchanger 12 where it is subcooled to −184° F. [−120° C.] by heat exchange with the cold LNG (stream 41*a*) as described previously. The subcooled reflux stream 53*a* is expanded to the operating pressure of demethanizer 21 by expansion valve 30 and the expanded stream 53*b* is then supplied as cold top column feed (reflux) to demethanizer 21. This cold liquid reflux absorbs and condenses the $C_2$ components and heavier hydrocarbon components from the vapors rising in the upper rectification section of demethanizer 21.

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 46 | 7,891 | 475 | 72 | 10 | 8,493 |
| 47 | 1,633 | 502 | 250 | 99 | 2,486 |
| 48 | 11,861 | 121 | 0 | 0 | 12,042 |
| 53 | 2,348 | 24 | 0 | 0 | 2,385 |
| 52 | 9,513 | 97 | 0 | 0 | 9,657 |
| 51 | 11 | 880 | 322 | 109 | 1,322 |

Recoveries*

| | |
|---|---|
| Ethane | 90.02% |
| Propane | 100.00% |
| Butanes+ | 100.00% |

Power

| | | |
|---|---|---|
| LNG Feed Pump | 457 HP | [752 kW] |
| LNG Product Pump | 756 HP | [1,242 kW] |
| Totals | 1,213 HP | [1,994 kW] |
| | Low Level Utility Heat | |
| LNG Heater | 16,394 MBTU/Hr | [10,590 kW] |
| | High Level Utility Heat | |
| Demethanizer Reboiler | 10,415 MBTU/Hr | [6,728 kW] |

*(Based on un-rounded flow rates)

Comparing Table V above for the FIG. 5 embodiment of the present invention with Table III for the FIG. 3 embodiment and Table IV for the FIG. 4 embodiment of the present invention shows that the liquids recovery is essentially the same for the FIG. 5 embodiment. Since the FIG. 5 embodiment does not use supplemental reflux for fractionation column 21 like the FIGS. 3 and 4 embodiments do (streams 42*a* and 45*b*, respectively), more top reflux (stream 53*b*) is required and less low level utility heating can be used in heat exchanger 14. This increases the load on reboiler 25 and increases the amount of high level utility heat required by the FIG. 5 embodiment of the present invention compared to the FIGS. 3 and 4 embodiments. The higher top reflux flow rate also increases the power requirements of the FIG. 5 embodiment slightly (by about 5% and 3%, respectively) compared to the FIGS. 3 and 4 embodiments. The choice of which embodiment to use for a particular application will generally be dictated by the relative costs of power and high level utility heat and the relative capital costs of columns, pumps, heat exchangers, and compressors.

EXAMPLE 4

Figure 6:
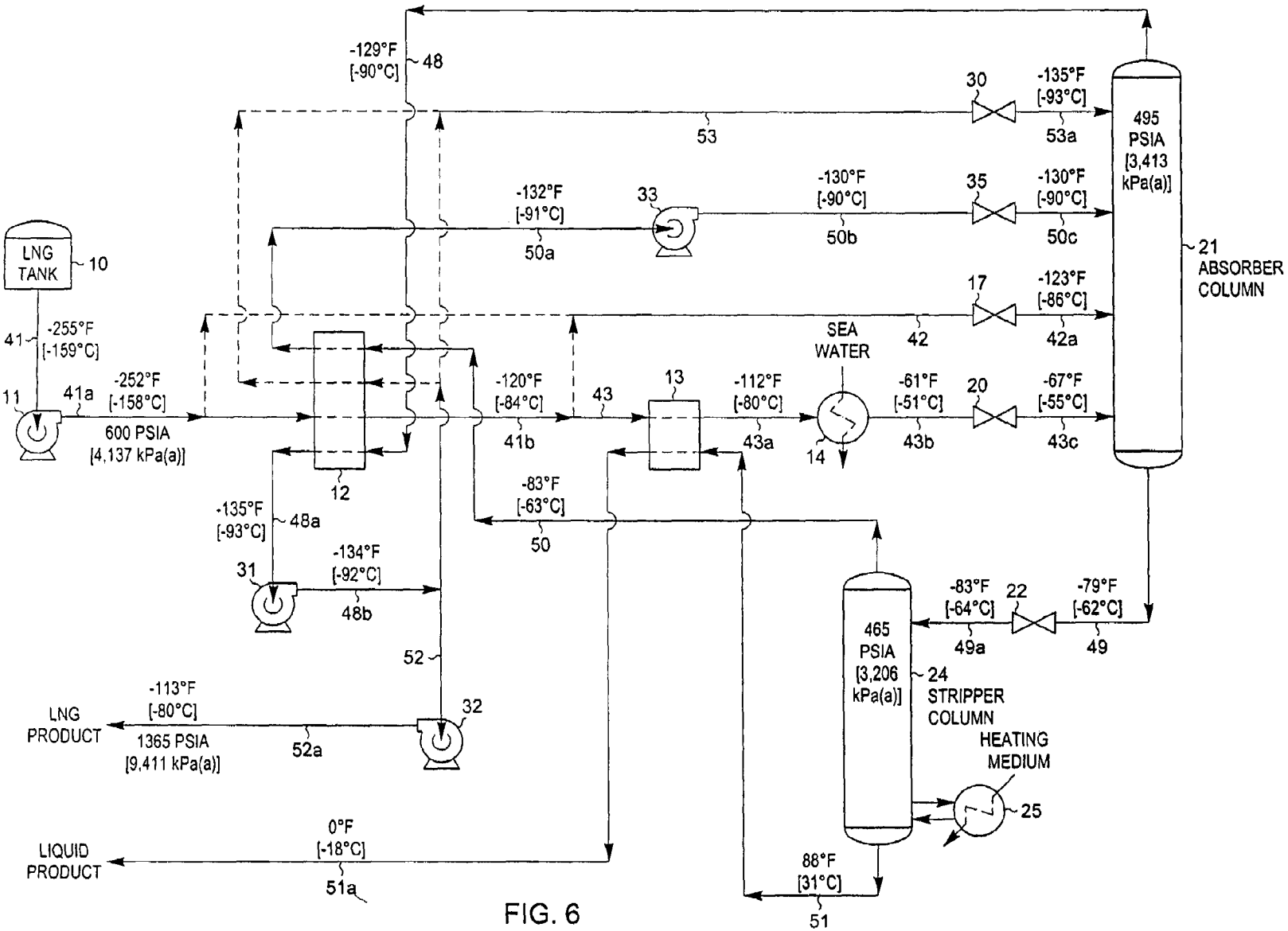

A slightly more complex design that maintains the same $C_2$ component recovery with lower power consumption can be achieved using another embodiment of the present invention as illustrated in the FIG. 6 process. The LNG composition and conditions considered in the process presented in FIG. 6 are the same as those in FIGS. 3 through 5, as well as those described previously for FIGS. 1 and 2. Accordingly, the FIG. 6 process of the present invention can be compared to the embodiments displayed in FIGS. 3 through 5 and to the prior art processes displayed in FIGS. 1 and 2.

In the simulation of the FIG. 6 process, the LNG to be processed (stream 41) from LNG tank 10 enters pump 11 at −255° F. [−159° C.]. Pump 11 elevates the pressure of the LNG sufficiently so that it can flow through heat exchangers and thence to absorber column 21. In the example shown in FIG. 6, stream 41*a* exiting the pump is first heated to −120° F. [−84° C.] in heat exchanger 12 by cooling the overhead vapor (distillation stream 48) withdrawn from contacting and separating device absorber column 21 at −129° F. [−90° C.] and the overhead vapor (distillation stream 50) withdrawn from fractionation stripper column 24 at −83° F. [−63° C.]. The partially heated liquid stream 41*b* is then divided into two portions, streams 42 and 43. The first portion, stream 42, is expanded to the operating pressure (approximately 495 psia [3,413 kPa(a)]) of absorber column 21 by expansion valve 17 and supplied to the tower at a lower mid-column feed point.

The second portion, stream 43, is heated prior to entering absorber column 21 so that all or a portion of it is vaporized. In the example shown in FIG. 6, stream 43 is first heated to −112° F. [−80° C.] in heat exchanger 13 by cooling the liquid product from fractionation stripper column 24 (stream 51) at 88° F. [31° C.]. The partially heated stream 43*a* is then further heated (stream 43*b*) in heat exchanger 14 using low level utility heat. The partially vaporized stream 43*b* is expanded to the operating pressure of absorber column 21 by expansion valve 20, cooling stream 43*c* to −67° F. [−55° C.] before it is supplied to absorber column 21 at a lower column feed point. The liquid portion (if any) of expanded stream 43*c* commingles with liquids falling downward from the upper section of absorber column 21 and the combined liquid stream 49 exits the bottom of absorber column 21 at −79° F. [−62° C.]. The vapor portion of expanded stream 43*c* rises upward through absorber column 21 and is contacted with cold liquid falling downward to condense and absorb the $C_2$ components and heavier hydrocarbon components.

The combined liquid stream 49 from the bottom of contacting device absorber column 21 is flash expanded to slightly above the operating pressure (465 psia [3,206 kPa (a)]) of stripper column 24 by expansion valve 22, cooling stream 49 to −83° F. [−64° C.] (stream 49*a*) before it enters fractionation stripper column 24 at a top column feed point. In the stripper column 24, stream 49*a* is stripped of its methane by the vapors generated in reboiler 25 to meet the specification of a methane fraction of 0.005 on a volume basis. The resulting liquid product stream 51 exits the bottom of stripper column 24 at 88° F. [31° C.], is cooled to 0° F. [−18° C.] in heat exchanger 13 (stream 51*a*) as described previously, and then flows to storage or further processing.

The overhead vapor (stream 50) from stripper column 24 exits the column at −83° F. [−63° C.] and flows to heat exchanger 12 where it is cooled to −132° F. [−91° C.] as previously described, totally condensing the stream. Condensed liquid stream 50*a* then enters overhead pump 33, which elevates the pressure of stream 50*b* to slightly above the operating pressure of absorber column 21. After expansion to the operating pressure of absorber column 21 by control valve 35, stream 50*c* at −130° F. [−90° C.] is then supplied to absorber column 21 at an upper mid-column feed point where it commingles with liquids falling downward from the upper section of absorber column 21 and becomes part of liquids used to capture the $C_2$ and heavier components in the vapors rising from the lower section of absorber column 21.

Overhead distillation stream 48, withdrawn from the upper section of absorber column 21 at −129° F. [−90° C.], flows to heat exchanger 12 and is cooled to −135° F. [−93° C.] as described previously, totally condensing the stream. The condensed liquid (stream 48*a*) is pumped to a pressure somewhat above the operating pressure of absorber column 21 by pump 31 (stream 48*b*), then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which is expanded to the operating pressure of absorber column 21 by control valve 30. The expanded stream 53*a* is then supplied at −135° F. [−93° C.] as cold top column feed (reflux) to absorber column 21. This cold liquid reflux absorbs and condenses the $C_2$ components and heavier hydrocarbon components from the vapors rising in the upper section of absorber column 21.

A summary of stream flow rates and energy consumption for the process illustrated in FIG. 6 is set forth in the following table:

TABLE VI (FIG. 6)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 2,769 | 284 | 94 | 32 | 3,192 |
| 43 | 6,755 | 693 | 228 | 77 | 7,787 |
| 48 | 10,546 | 108 | 0 | 0 | 10,706 |
| 49 | 1,373 | 994 | 329 | 109 | 2,808 |
| 50 | 1,362 | 114 | 7 | 0 | 1,486 |
| 53 | 1,033 | 11 | 0 | 0 | 1,049 |
| 52 | 9,513 | 97 | 0 | 0 | 9,657 |
| 51 | 11 | 880 | 322 | 109 | 1,322 |

Recoveries*

| | |
|---|---|
| Ethane | 90.04% |
| Propane | 99.88% |
| Butanes+ | 100.00% |

| Power | | |
|---|---|---|
| LNG Feed Pump | 359 HP | [590 kW] |
| Absorber Overhead Pump | 48 HP | [79 kW] |
| Stripper Overhead Pump | 11 HP | [18 kW] |
| LNG Product Pump | 717 HP | [1,179 kW] |
| Totals | 1,135 HP | [1,866 kW] |
| Low Level Utility Heat | | |
| LNG Heater | 16,514 MBTU/Hr | [10,667 kW] |
| High Level Utility Heat | | |
| Demethanizer Reboiler | 8,358 MBTU/Hr | [5,399 kW] |

*(Based on un-rounded flow rates)

Comparing Table VI above for the FIG. 6 embodiment of the present invention with Tables III through V for the FIGS. 3 through 5 embodiments of the present invention shows that the liquids recovery is essentially the same for the FIG. 6 embodiment. However, comparing the utilities consumptions in Table VI with those in Tables III through V shows that both the power required and the high level utility heat required for the FIG. 6 embodiment of the present invention are lower than for the FIGS. 3 through 5 embodiments. The power requirement for the FIG. 6 embodiment is 1%, 4%, and 6% lower, respectively and the high level utility heat requirement is 1%, 4%, and 20% lower, respectively.

The reductions in utilities requirements for the FIG. 6 embodiment of the present invention relative to the FIGS. 3 through 5 embodiments can be attributed mainly to two factors. First, by splitting fractionation column 21 in the FIGS. 3 through 5 embodiments into a separate absorber column 21 and stripper column 24, the operating pressures of the two columns can be optimized independently for their respective services. The operating pressure of fractionation column 21 in the FIGS. 3 through 5 embodiments cannot be raised much above the values shown without incurring the detrimental effect on distillation performance that would result from the higher operating pressure. This effect is manifested by poor mass transfer in fractionation column 21 due to the phase behavior of its vapor and liquid streams. Of particular concern are the physical properties that affect the vapor-liquid separation efficiency, namely the liquid surface tension and the differential in the densities of the two phases. With the operating pressures of the rectification operation (absorber column 21) and the stripping operation (stripper column 24) no longer coupled together as they are in the FIGS. 3 through 5 embodiments, the stripping operation can be conducted at a reasonable operating pressure while conducting the rectification operation at a higher pressure that facilitates the condensation of its overhead stream (stream 48 in the FIG. 6 embodiment) in heat exchanger 12.

Second, in addition to the portion of the LNG feed stream used as a supplemental reflux stream in the FIGS. 3 and 4 embodiments (stream 42*a* in FIG. 3 and stream 45*b* in FIG. 4), the FIG. 6 embodiment of the present invention uses a second supplemental reflux stream (stream 50*c*) for absorber column 21 to help rectify the vapors in stream 43*c* entering the lower section of absorber column 21. This allows for more optimal use of low level utility heat in heat exchanger 14 to reduce the load on reboiler 25, reducing the high level utility heat requirement. The choice of which embodiment to use for a particular application will generally be dictated by the relative costs of power and high level utility heat and the relative capital costs of columns, pumps, heat exchangers, and compressors.

EXAMPLE 5

Figure 7:
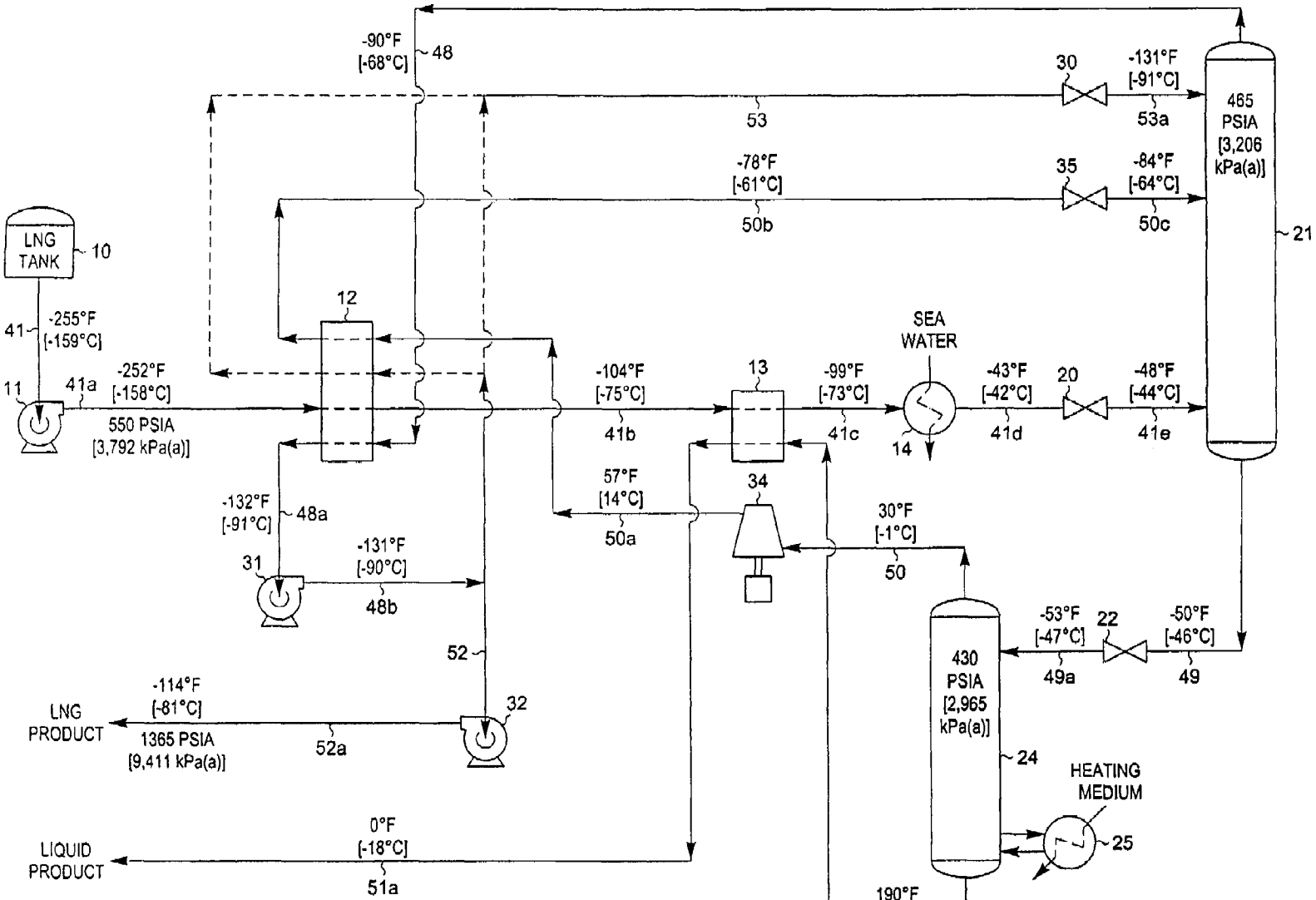

The present invention can also be adapted to produce an LPG product containing the majority of the $C_3$ components and heavier hydrocarbon components present in the feed stream as shown in FIG. 7. The LNG composition and conditions considered in the process presented in FIG. 7 are the same as described previously for FIGS. 1 through 6. Accordingly, the FIG. 7 process of the present invention can be compared to the prior art processes displayed in FIGS. 1 and 2 as well as to the other embodiments of the present invention displayed in FIGS. 3 through 6.

In the simulation of the FIG. 7 process, the LNG to be processed (stream 41) from LNG tank 10 enters pump 11 at −255° F. [−159° C.]. Pump 11 elevates the pressure of the LNG sufficiently so that it can flow through heat exchangers and thence to absorber column 21. In the example shown in FIG. 7, stream 41*a* exiting the pump is first heated to −99° F. [−73° C.] in heat exchangers 12 and 13 by cooling the overhead vapor (distillation stream 48) withdrawn from contacting and separating device absorber column 21 at −90° F. [−68° C.], the compressed overhead vapor (stream 50*a*) at 57° F. [14° C.] which was withdrawn from fractionation stripper column 24, and the liquid product from fractionation stripper column 24 (stream 51) at 190° F. [88° C.].

The partially heated stream 41*c* is then further heated (stream 41*d*) to −43° F. [−42° C.] in heat exchanger 14 using low level utility heat. The partially vaporized stream 41*d* is expanded to the operating pressure (approximately 465 psia [3,206 kPa(a)]) of absorber column 21 by expansion valve 20, cooling stream 41*e* to −48° F. [−44° C.] before it is supplied to absorber column 21 at a lower column feed point. The liquid portion (if any) of expanded stream 41*e* commingles with liquids falling downward from the upper section of absorber column 21 and the combined liquid stream 49 exits the bottom of absorber column 21 at −50° F. [−46° C.]. The vapor portion of expanded stream 41*e* rises upward through absorber column 21 and is contacted with cold liquid falling downward to condense and absorb the $C_3$ components and heavier hydrocarbon components.

The combined liquid stream 49 from the bottom of contacting device absorber column 21 is flash expanded to slightly above the operating pressure (430 psia [2,965 kPa (a)]) of stripper column 24 by expansion valve 22, cooling stream 49 to −53° F. [−47° C.] (stream 49*a*) before it enters fractionation stripper column 24 at a top column feed point. In the stripper column 24, stream 49*a* is stripped of its methane and $C_2$ components by the vapors generated in reboiler 25 to meet the specification of an ethane to propane ratio of 0.020:1 on a molar basis. The resulting liquid product stream 51 exits the bottom of stripper column 24 at 190° F. [88° C.], is cooled to 0° F. [−18° C.] in heat exchanger 13 (stream 51*a*) as described previously, and then flows to storage or further processing.

The overhead vapor (stream 50) from stripper column 24 exits the column at 30° F. [−1° C.] and flows to overhead compressor 34 (driven by a supplemental power source), which elevates the pressure of stream 50*a* to slightly above the operating pressure of absorber column 21. Stream 50*a* enters heat exchanger 12 where it is cooled to −78° F. [−61° C.] as previously described, totally condensing the stream. Condensed liquid stream 50*b* is expanded to the operating pressure of absorber column 21 by control valve 35, and the resulting stream 50*c* at −84° F. [−64° C.] is then supplied to absorber column 21 at a mid-column feed point where it commingles with liquids falling downward from the upper section of absorber column 21 and becomes part of liquids used to capture the $C_3$ and heavier components in the vapors rising from the lower section of absorber column 21.

Overhead distillation stream 48, withdrawn from the upper section of absorber column 21 at −90° F. [−68° C.], flows to heat exchanger 12 and is cooled to −132° F. [−91° C.] as described previously, totally condensing the stream. The condensed liquid (stream 48*a*) is pumped to a pressure somewhat above the operating pressure of absorber column 21 by pump 31 (stream 48*b*), then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which is expanded to the operating pressure of absorber column 21 by control valve 30. The expanded stream 53*a* is then supplied at −131° F. [−91° C.] as cold top column feed (reflux) to absorber column 21. This cold liquid reflux absorbs and condenses the $C_3$ components and heavier hydrocarbon components from the vapors rising in the upper section of absorber column 21.

A summary of stream flow rates and energy consumption for the process illustrated in FIG. 7 is set forth in the following table:

TABLE VII (FIG. 7)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 48 | 11,475 | 1,170 | 4 | 0 | 12,705 |
| 49 | 426 | 326 | 396 | 116 | 1,266 |
| 50 | 426 | 320 | 77 | 7 | 832 |
| 53 | 1,951 | 199 | 1 | 0 | 2,160 |
| 52 | 9,524 | 971 | 3 | 0 | 10,545 |
| 51 | 0 | 6 | 319 | 109 | 434 |

Recoveries*

| | |
|---|---|
| Propane | 99.00% |
| Butanes+ | 100.00% |

Power

| | | |
|---|---|---|
| LNG Feed Pump | 325 HP | [535 kW] |
| Absorber Overhead Pump | 54 HP | [89 kW] |
| LNG Product Pump | 775 HP | [1,274 kW] |
| Stripper Ovhd Compressor | 67 HP | [110 kW] |
| Totals | 1,221 HP | [2,008 kW] |
| Low Level Utility Heat | | |
| LNG Heater | 15,139 MBTU/Hr | [9,779 kW] |
| High Level Utility Heat | | |
| Deethanizer Reboiler | 6,857 MBTU/Hr | [4,429 kW] |

*(Based on un-rounded flow rates)

Comparing the utilities consumptions in Table VII above for the FIG. 7 process with those in Tables III through VI shows that the power requirement for this embodiment of the present invention is slightly higher than that of the FIGS. 3 through 6 embodiments. However, the high level utility heat required for the FIG. 7 embodiment of the present invention is significantly lower than that for the FIGS. 3 through 6 embodiments because more low level utility heat can be used in heat exchanger 14 when recovery of the $C_2$ components is not desired.

EXAMPLE 6

Figure 8:
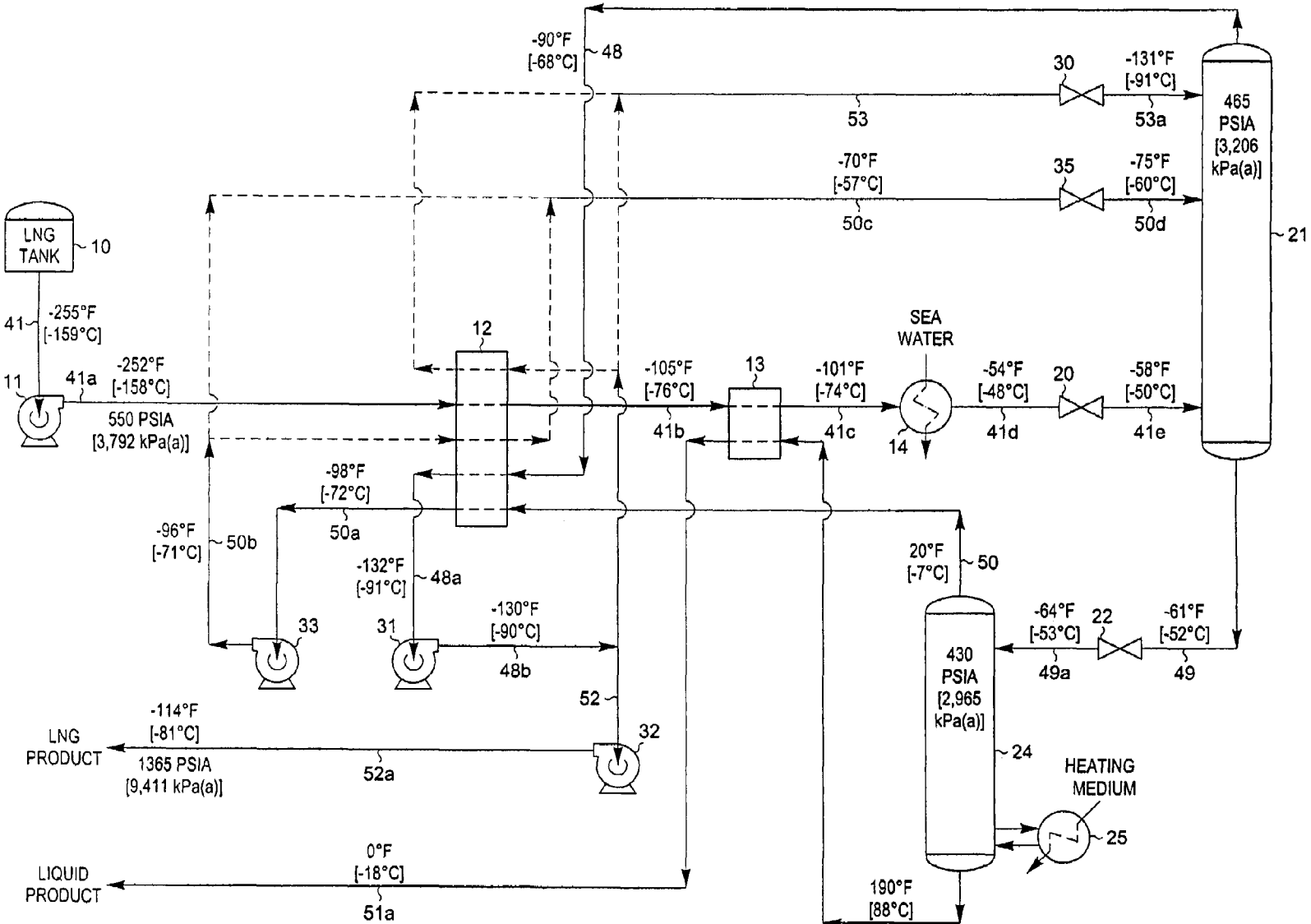

The increase in the power requirement of the FIG. 7 embodiment relative to the FIGS. 3 through 6 embodiments of the present invention is mainly due to compressor 34 in FIG. 7 which provides the motive force needed to direct the overhead vapor (stream 50) from stripper column 24 through heat exchanger 12 and thence into absorber column 21. FIG. 8 illustrates an alternative embodiment of the present invention that eliminates this compressor and reduces the power requirement. The LNG composition and conditions considered in the process presented in FIG. 8 are the same as those in FIG. 7, as well as those described previously for FIGS. 1 through 6. Accordingly, the FIG. 8 process of the present invention can be compared to the embodiment of the present invention displayed in FIG. 7, to the prior art processes displayed in FIGS. 1 and 2, and to the other embodiments of the present invention displayed in FIGS. 3 through 6.

In the simulation of the FIG. 8 process, the LNG to be processed (stream 41) from LNG tank 10 enters pump 11 at −255° F. [−159° C.]. Pump 11 elevates the pressure of the LNG sufficiently so that it can flow through heat exchangers and thence to absorber column 21. Stream 41*a* exiting the pump is heated first to −101° F. [−74° C.] in heat exchangers 12 and 13 as it provides cooling to the overhead vapor (distillation stream 48) withdrawn from contacting and separating device absorber column 21 at −90° F. [−68° C.], the overhead vapor (distillation stream 50) withdrawn from fractionation stripper column 24 at 20° F. [−7° C.], and the liquid product (stream 51) from fractionation stripper column 21 at 190° F. [88° C.].

The partially heated stream 41*c* is then further heated (stream 41*d*) in heat exchanger 14 to −54° F. [−48° C.] using low level utility heat. After expansion to the operating pressure (approximately 465 psia [3,206 kPa(a)]) of absorber column 21 by expansion valve 20, stream 41*e* flows to a lower column feed point on the column at −58° F. [−50° C.]. The liquid portion (if any) of expanded stream 41*e* commingles with liquids falling downward from the upper section of absorber column 21 and the combined liquid stream 49 exits the bottom of contacting device absorber column 21 at −61° F. [−52° C.]. The vapor portion of expanded stream 41*e* rises upward through absorber column 21 and is contacted with cold liquid falling downward to condense and absorb the $C_3$ components and heavier hydrocarbon components.

The combined liquid stream 49 from the bottom of the absorber column 21 is flash expanded to slightly above the operating pressure (430 psia [2,965 kPa(a)]) of stripper column 24 by expansion valve 22, cooling stream 49 to −64° F. [−53° C.] (stream 49*a*) before it enters fractionation stripper column 24 at a top column feed point. In stripper column 24, stream 49*a* is stripped of its methane and $C_2$ components by the vapors generated in reboiler 25 to meet the specification of an ethane to propane ratio of 0.020:1 on a molar basis. The resulting liquid product stream 51 exits the bottom of stripper column 24 at 190° F. [88° C.] and is cooled to 0° F. [−18° C.] in heat exchanger 13 (stream 51*a*) as described previously before flowing to storage or further processing.

The overhead vapor (stream 50) from stripper column 24 exits the column at 20° F. [−7° C.] and flows to heat exchanger 12 where it is cooled to −98° F. [−72° C.] as previously described, totally condensing the stream. Condensed liquid stream 50*a* then enters overhead pump 33, which elevates the pressure of stream 50*b* to slightly above the operating pressure of absorber column 21, whereupon it reenters heat exchanger 12 to be partially vaporized as it is heated to −70° F. [−57° C.] (stream 50*c*) by supplying part of the total cooling duty in this exchanger. After expansion to the operating pressure of absorber column 21 by control valve 35, stream 50*d* at −75° F. [−60° C.] is then supplied to absorber column 21 at a mid-column feed point where it commingles with liquids falling downward from the upper section of absorber column 21 and becomes part of liquids used to capture the $C_3$ and heavier components in the vapors rising from the lower section of absorber column 21.

Overhead distillation stream 48 is withdrawn from contacting device absorber column 21 at −90° F. [−68° C.] and flows to heat exchanger 12 where it is cooled to −132° F. [−91° C.] and totally condensed by heat exchange with the cold LNG (stream 41*a*) as described previously. The condensed liquid (stream 48*a*) is pumped to a pressure somewhat above the operating pressure of absorber column 21 by pump 31 (stream 48*b*), then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which is expanded to the operating pressure of absorber column 21 by control valve 30. The expanded stream 53*a* is then supplied at −131° F. [−91° C.] as cold top column feed (reflux) to absorber column 21. This cold liquid reflux absorbs and condenses the $C_3$ components and heavier hydrocarbon components from the vapors rising in the upper section of absorber column 21.

A summary of stream flow rates and energy consumption for the process illustrated in FIG. 8 is set forth in the following table:

TABLE VIII (FIG. 8)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 48 | 10,934 | 1,115 | 4 | 0 | 12,107 |
| 49 | 582 | 458 | 396 | 116 | 1,552 |
| 50 | 582 | 452 | 77 | 7 | 1,118 |
| 53 | 1,410 | 144 | 1 | 0 | 1,562 |
| 52 | 9,524 | 971 | 3 | 0 | 10,545 |
| 51 | 0 | 6 | 319 | 109 | 434 |

Recoveries*

| | |
|---|---|
| Propane | 99.03% |
| Butanes+ | 100.00% |

Power

| | | |
|---|---|---|
| LNG Feed Pump | 325 HP | [534 kW] |
| Absorber Overhead Pump | 67 HP | [110 kW] |
| Stripper Overhead Pump | 11 HP | [18 kW] |
| LNG Product Pump | 761 HP | [1,251 kW] |
| Totals | 1,164 HP | [1,913 kW] |
| Low Level Utility Heat | | |
| LNG Heater | 13,949 MBTU/Hr | [9,010 kW] |
| High Level Utility Heat | | |
| Deethanizer Reboiler | 8,192 MBTU/Hr | [5,292 kW] |

*(Based on un-rounded flow rates)

Comparing Table VIII above for the FIG. 8 embodiment of the present invention with Table VII for the FIG. 7 embodiment of the present invention shows that the liquids recovery is essentially the same for the FIG. 8 embodiment. Since the FIG. 8 embodiment uses a pump (overhead pump 33 in FIG. 8) rather than a compressor (overhead compressor 34 in FIG. 7) to route the overhead vapor from fractionation stripper column 24 to contacting device absorber column 21, less power is required by the FIG. 8 embodiment. However, the high level utility heat required for the FIG. 8 embodiment is higher (by about 19%). The choice of which embodiment to use for a particular application will generally be dictated by the relative costs of power and high level utility heat and the relative costs of pumps versus compressors.

EXAMPLE 7

Figure 9:
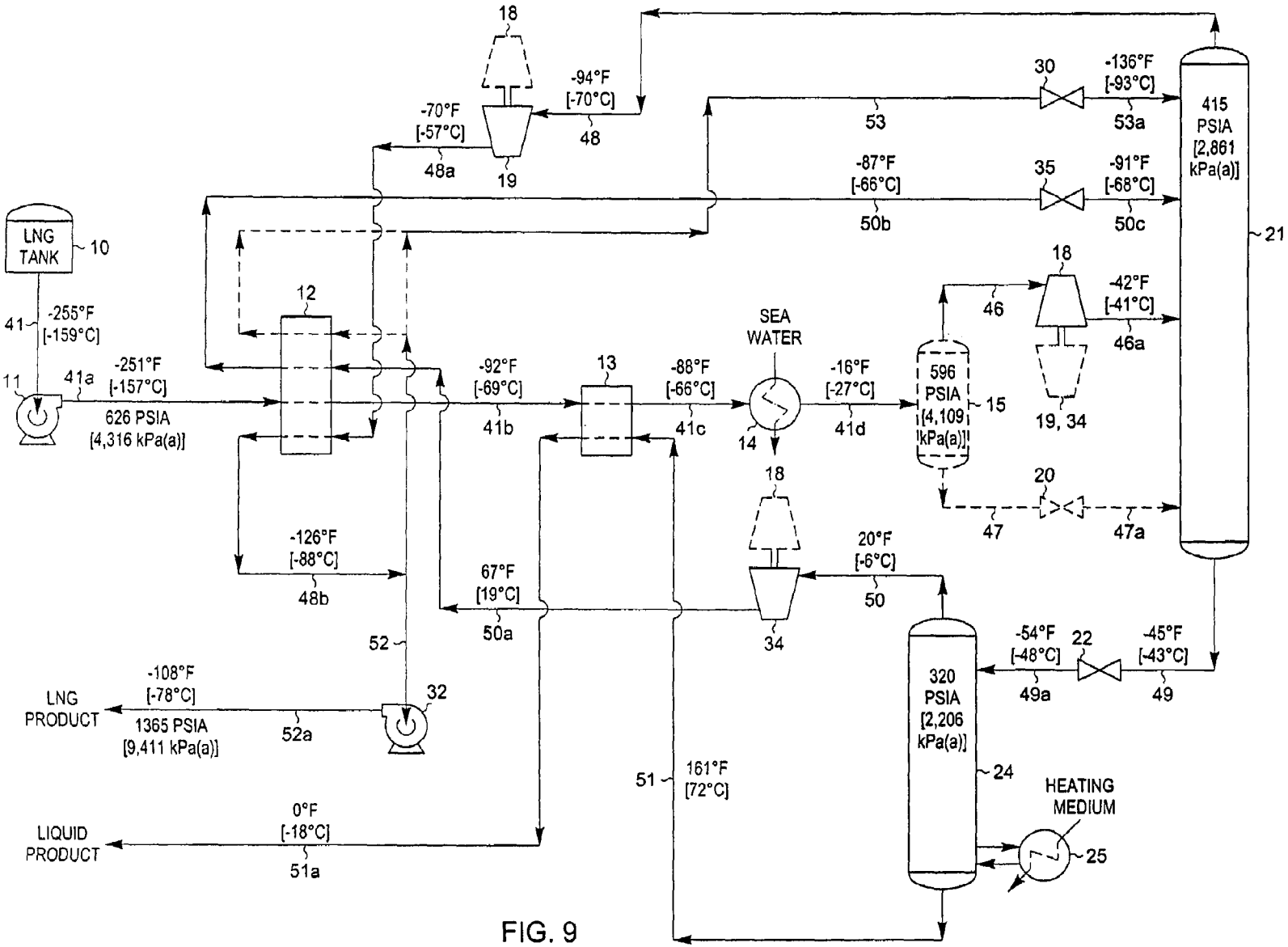

A slightly more complex design that maintains the same $C_3$ component recovery with reduced high level utility heat consumption can be achieved using another embodiment of the present invention as illustrated in the FIG. 9 process. The LNG composition and conditions considered in the process presented in FIG. 9 are the same as those in FIGS. 7 and 8, as well as those described previously for FIGS. 1 through 6. Accordingly, the FIG. 9 process of the present invention can be compared to the embodiments of the present invention displayed in FIGS. 7 and 8, to the prior art processes displayed in FIGS. 1 and 2, and to the other embodiments of the present invention displayed in FIGS. 3 through 6.

In the simulation of the FIG. 9 process, the LNG to be processed (stream 41) from LNG tank 10 enters pump 11 at −255° F. [−159° C.]. Pump 11 elevates the pressure of the LNG sufficiently so that it can flow through heat exchangers and thence to separator 15. Stream 41*a* exiting the pump is heated prior to entering separator 15 so that all or a portion of it is vaporized. In the example shown in FIG. 9, stream 41*a* is first heated to −88° F. [−66° C.] in heat exchangers 12 and 13 by cooling compressed overhead vapor stream 48*a* at −70° F. [−57° C.], compressed overhead vapor stream 50*a* at 67° F. [19° C.], and the liquid product from fractionation stripper column 24 (stream 51) at 161° F. [72° C.]. The partially heated stream 41*c* is then further heated (stream 41*d*) in heat exchanger 14 using low level utility heat.

The heated stream 41*d* enters separator 15 at −16° F. [−27° C.] and 596 psia [4,109 kPa(a)] where the vapor (stream 46) is separated from any remaining liquid (stream 47). The separator vapor (stream 46) enters a work expansion machine 18 in which mechanical energy is extracted from this portion of the high pressure feed. The machine 18 expands the vapor substantially isentropically to the tower operating pressure (approximately 415 psia [2,861 kPa(a)]), with the work expansion cooling the expanded stream 46*a* to a temperature of approximately −42° F. [−41° C.]. The partially condensed expanded stream 46*a* is thereafter supplied as feed to absorber column 21 at a mid-column feed point. If there is any separator liquid (stream 47), it is expanded to the operating pressure of absorber column 21 by expansion valve 20 before it is supplied to absorber column 21 at a lower column feed point. In the example shown in FIG. 9, stream 41*d* is vaporized completely in heat exchanger 14, so separator 15 and expansion valve 20 are not needed, and expanded stream 46*a* is supplied to absorber column 21 at a lower column feed point instead. The liquid portion (if any) of expanded stream 46*a* (and expanded stream 47*a* if present) commingles with liquids falling downward from the upper section of absorber column 21 and the combined liquid stream 49 exits the bottom of absorber column 21 at −45° F. [−43° C.]. The vapor portion of expanded stream 46*a* (and expanded stream 47*a* if present) rises upward through absorber column 21 and is contacted with cold liquid falling downward to condense and absorb the $C_3$ components and heavier hydrocarbon components.

The combined liquid stream 49 from the bottom of contacting and separating device absorber column 21 is flash expanded to slightly above the operating pressure (320 psia [2,206 kPa(a)]) of fractionation stripper column 24 by expansion valve 22, cooling stream 49 to −54° F. [−48° C.] (stream 49*a*) before it enters fractionation stripper column 24 at a top column feed point. In stripper column 24, stream 49*a* is stripped of its methane and $C_2$ components by the vapors generated in reboiler 25 to meet the specification of an ethane to propane ratio of 0.020:1 on a molar basis. The resulting liquid product stream 51 exits the bottom of stripper column 24 at 161° F. [72° C.] and is cooled to 0° F. [−18° C.] in heat exchanger 13 (stream 51*a*) as described previously before flowing to storage or further processing.

The overhead vapor (stream 50) from stripper column 24 exits the column at 20° F. [−6° C.] flows to overhead compressor 34 (driven by a portion of the power generated by expansion machine 18), which elevates the pressure of stream 50*a* to slightly above the operating pressure of absorber column 21. Stream 50*a* enters heat exchanger 12 where it is cooled to −87° F. [−66° C.] as previously described, totally condensing the stream. Condensed liquid stream 50*b* is expanded to the operating pressure of absorber column 21 by control valve 35, and the resulting stream 50*c* at −91° F. [−68° C.] is then supplied to absorber column 21 at a mid-column feed point where it commingles with liquids falling downward from the upper section of absorber column 21 and becomes part of liquids used to capture the $C_3$ and heavier components in the vapors rising from the lower section of absorber column 21.

Overhead distillation stream 48 is withdrawn from the upper section of absorber column 21 at −94° F. [−70° C.] and flows to compressor 19 (driven by the remaining portion of the power generated by expansion machine 18), where it is compressed to 508 psia [3,501 kPa(a)] (stream 48*a*). At this pressure, the stream is totally condensed as it is cooled to −126° F. [−88° C.] in heat exchanger 12 as described previously. The condensed liquid (stream 48*b*) is then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which is expanded to the operating pressure of absorber column 21 by expansion valve 30. The expanded stream 53*a* is then supplied at −136° F. [−93° C.] as cold top column feed (reflux) to absorber column 21. This cold liquid reflux absorbs and condenses the $C_3$ components and heavier hydrocarbon components from the vapors rising in the upper section of absorber column 21.

A summary of stream flow rates and energy consumption for the process illustrated in FIG. 9 is set forth in the following table:

TABLE IX (FIG. 9)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 46 | 9,524 | 977 | 322 | 109 | 10,979 |
| 48 | 12,056 | 1,229 | 4 | 0 | 13,348 |
| 49 | 304 | 254 | 384 | 115 | 1,057 |
| 50 | 304 | 248 | 65 | 6 | 623 |
| 53 | 2,532 | 258 | 1 | 0 | 2,803 |
| 52 | 9,524 | 971 | 3 | 0 | 10,545 |
| 51 | 0 | 6 | 319 | 109 | 434 |

Recoveries*

| | |
|---|---|
| Propane | 98.99% |
| Butanes+ | 100.00% |

Power

| | | |
|---|---|---|
| LNG Feed Pump | 377 HP | [620 kW] |
| LNG Product Pump | 806 HP | [1,325 kW] |
| Totals | 1,183 HP | [1,945 kW] |
| | Low Level Utility Heat | |
| LNG Heater | 17,940 MBTU/Hr | [11,588 kW] |
| | High Level Utility Heat | |
| Deethanizer Reboiler | 5,432 MBTU/Hr | [3,509 kW] |

*(Based on un-rounded flow rates)

Comparing Table IX above for the FIG. 9 embodiment of the present invention with Tables VII and VIII for the FIGS. 7 and 8 embodiments of the present invention shows that the liquids recovery is essentially the same for the FIG. 9 embodiment. The power requirement for the FIG. 9 embodiment is lower than that required by the FIG. 7 embodiment by about 3% and higher than that required by the FIG. 8 embodiment by about 2%. However, the high level utility heat required by the FIG. 9 embodiment of the present invention is significantly lower than either the FIG. 7 embodiment (by about 21%) or the FIG. 8 embodiment (by about 34%). The choice of which embodiment to use for a particular application will generally be dictated by the relative costs of power versus high level utility heat and the relative capital costs of pumps and heat exchangers versus compressors and expansion machines.

EXAMPLE 8

Figure 10:
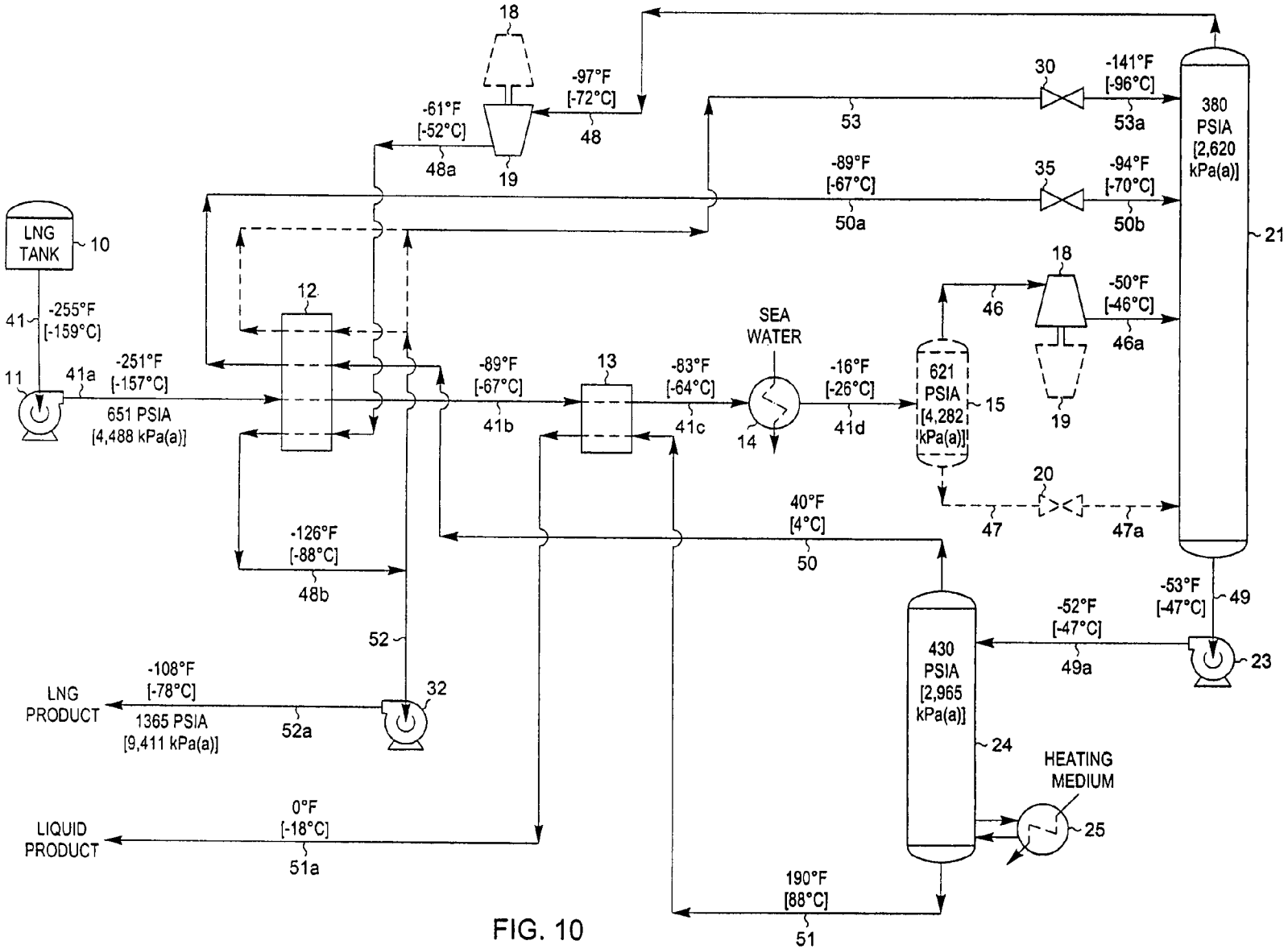
Figure 11:
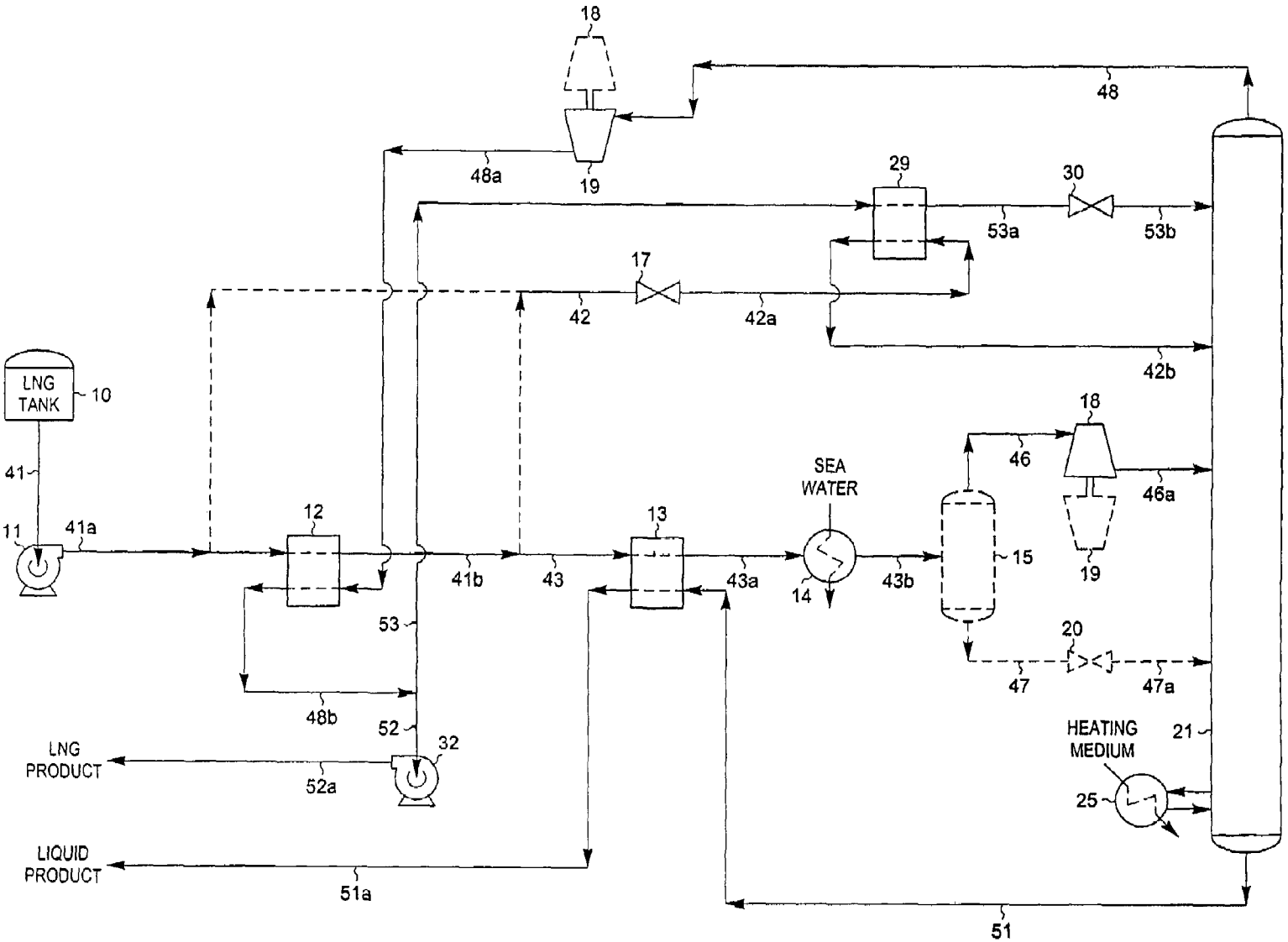

A slightly simpler embodiment of the present invention that maintains the same $C_3$ component recovery as the FIG. 9 embodiment can be achieved using another embodiment of the present invention as illustrated in the FIG. 10 process. The LNG composition and conditions considered in the process presented in FIG. 10 are the same as those in FIGS. 7 through 9, as well as those described previously for FIGS. 1 through 6. Accordingly, the FIG. 10 process of the present invention can be compared to the embodiments of the present invention displayed in FIGS. 7 through 9, to the prior art processes displayed in FIGS. 1 and 2, and to the other embodiments of the present invention displayed in FIGS. 3 through 6.

In the simulation of the FIG. 10 process, the LNG to be processed (stream 41) from LNG tank 10 enters pump 11 at −255° F. [−159° C.]. Pump 11 elevates the pressure of the LNG sufficiently so that it can flow through heat exchangers and thence to separator 15. Stream 41*a* exiting the pump is heated prior to entering separator 15 so that all or a portion of it is vaporized. In the example shown in FIG. 10, stream 41*a* is first heated to −83° F. [−64° C.] in heat exchangers 12 and 13 by cooling compressed overhead vapor stream 48*a* at −61° F. [−52° C.], overhead vapor stream 50 at 40° F. [4° C.], and the liquid product from fractionation stripper column 24 (stream 51) at 190° F. [88° C.]. The partially heated stream 41*c* is then further heated (stream 41*d*) in heat exchanger 14 using low level utility heat.

The heated stream 41*d* enters separator 15 at −16° F. [−26° C.] and 621 psia [4,282 kPa(a)] where the vapor (stream 46) is separated from any remaining liquid (stream 47). The separator vapor (stream 46) enters a work expansion machine 18 in which mechanical energy is extracted from this portion of the high pressure feed. The machine 18 expands the vapor substantially isentropically to the tower operating pressure (approximately 380 psia [2,620 kPa(a)]), with the work expansion cooling the expanded stream 46*a* to a temperature of approximately −50° F. [−46° C.]. The partially condensed expanded stream 46*a* is thereafter supplied as feed to absorber column 21 at a mid-column feed point. If there is any separator liquid (stream 47), it is expanded to the operating pressure of absorber column 21 by expansion valve 20 before it is supplied to absorber column 21 at a lower column feed point. In the example shown in FIG. 10, stream 41*d* is vaporized completely in heat exchanger 14, so separator 15 and expansion valve 20 are not needed, and expanded stream 46*a* is supplied to absorber column 21 at a lower column feed point instead. The liquid portion (if any) of expanded stream 46*a* (and expanded stream 47*a* if present) commingles with liquids falling downward from the upper section of absorber column 21 and the combined liquid stream 49 exits the bottom of absorber column 21 at −53° F. [−47° C.]. The vapor portion of expanded stream 46*a* (and expanded stream 47*a* if present) rises upward through absorber column 21 and is contacted with cold liquid falling downward to condense and absorb the $C_3$ components and heavier hydrocarbon components.

The combined liquid stream 49 from the bottom of contacting and separating device absorber column 21 enters pump 23 and is pumped to slightly above the operating pressure (430 psia [2,965 kPa(a)]) of stripper column 24. The resulting stream 49*a* at −52° F. [−47° C.] then enters fractionation stripper column 24 at a top column feed point. In stripper column 24, stream 49*a* is stripped of its methane and $C_2$ components by the vapors generated in reboiler 25 to meet the specification of an ethane to propane ratio of 0.020:1 on a molar basis. The resulting liquid product stream 51 exits the bottom of stripper column 24 at 190° F. [88° C.] and is cooled to 0° F. [−18° C.] in heat exchanger 13 (stream 51*a*) as described previously before flowing to storage or further processing.

The overhead vapor (stream 50) from stripper column 24 exits the column at 40° F. [4° C.] and enters heat exchanger 12 where it is cooled to −89° F. [−67° C.] as previously described, totally condensing the stream. Condensed liquid stream 50*a* is expanded to the operating pressure of absorber column 21 by expansion valve 35, and the resulting stream 50*b* at −94° F. [−70° C.] is then supplied to absorber column 21 at a mid-column feed point where it commingles with liquids falling downward from the upper section of absorber column 21 and becomes part of liquids used to capture the $C_3$ and heavier components in the vapors rising from the lower section of absorber column 21.

Overhead distillation stream 48 is withdrawn from the upper section of absorber column 21 at −97° F. [−72° C.] and flows to compressor 19 driven by expansion machine 18, where it is compressed to 507 psia [3,496 kPa(a)] (stream 48*a*). At this pressure, the stream is totally condensed as it is cooled to −126° F. [−88° C.] in heat exchanger 12 as described previously. The condensed liquid (stream 48*b*) is then divided into two portions, streams 52 and 53. The first portion (stream 52) is the methane-rich lean LNG stream, which is then pumped by pump 32 to 1365 psia [9,411 kPa(a)] (stream 52*a*) for subsequent vaporization and/or transportation.

The remaining portion is reflux stream 53, which is expanded to the operating pressure of absorber column 21 by expansion valve 30. The expanded stream 53*a* is then supplied at −141° F. [−96° C.] as cold top column feed (reflux) to absorber column 21. This cold liquid reflux absorbs and condenses the $C_3$ components and heavier hydrocarbon components from the vapors rising in the upper section of absorber column 21.

A summary of stream flow rates and energy consumption for the process illustrated in FIG. 10 is set forth in the following table:

TABLE X (FIG. 10)
Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 46 | 9,524 | 977 | 322 | 109 | 10,979 |
| 48 | 11,631 | 1,186 | 4 | 0 | 12,879 |
| 49 | 309 | 275 | 395 | 117 | 1,096 |
| 50 | 309 | 269 | 76 | 8 | 662 |
| 53 | 2,107 | 215 | 1 | 0 | 2,334 |
| 52 | 9,524 | 971 | 3 | 0 | 10,545 |
| 51 | 0 | 6 | 319 | 109 | 434 |

TABLE X-continued

Recoveries*

| | |
|---|---|
| Propane | 99.02% |
| Butanes+ | 100.00% |

Power

| | | |
|---|---|---|
| LNG Feed Pump | 394 HP | [648 kW] |
| Absorber Bottoms Pump | 9 HP | [14 kW] |
| LNG Product Pump | 806 HP | [1,325 kW] |
| Totals | 1,209 HP | [1,987 kW] |
| | Low Level Utility Heat | |
| LNG Heater | 16,912 MBTU/Hr | [10,924 kW] |
| | High Level Utility Heat | |
| Deethanizer Reboiler | 6,390 MBTU/Hr | [4,127 kW] |

*(Based on un-rounded flow rates)

Comparing Table X above for the FIG. 10 embodiment of the present invention with Tables VII through IX for the FIGS. 7 through 9 embodiments of the present invention shows that the liquids recovery is essentially the same for the FIG. 10 embodiment. The power requirement for the FIG. 10 embodiment is lower than that required by the FIG. 7 embodiment by about 1% and higher than that required by the FIGS. 8 and 9 embodiments by about 4% and 2%, respectively. The high level utility heat required by the FIG. 10 embodiment of the present invention is significantly lower than both the FIGS. 7 and 8 embodiments (by about 7% and 22%, respectively), but higher than the FIG. 9 embodiment by about 18%. The choice of which embodiment to use for a particular application will generally be dictated by the relative costs of power versus high level utility heat and the relative capital costs of pumps, heat exchangers, compressors, and expansion machines.

Other Embodiments

Figure 12:
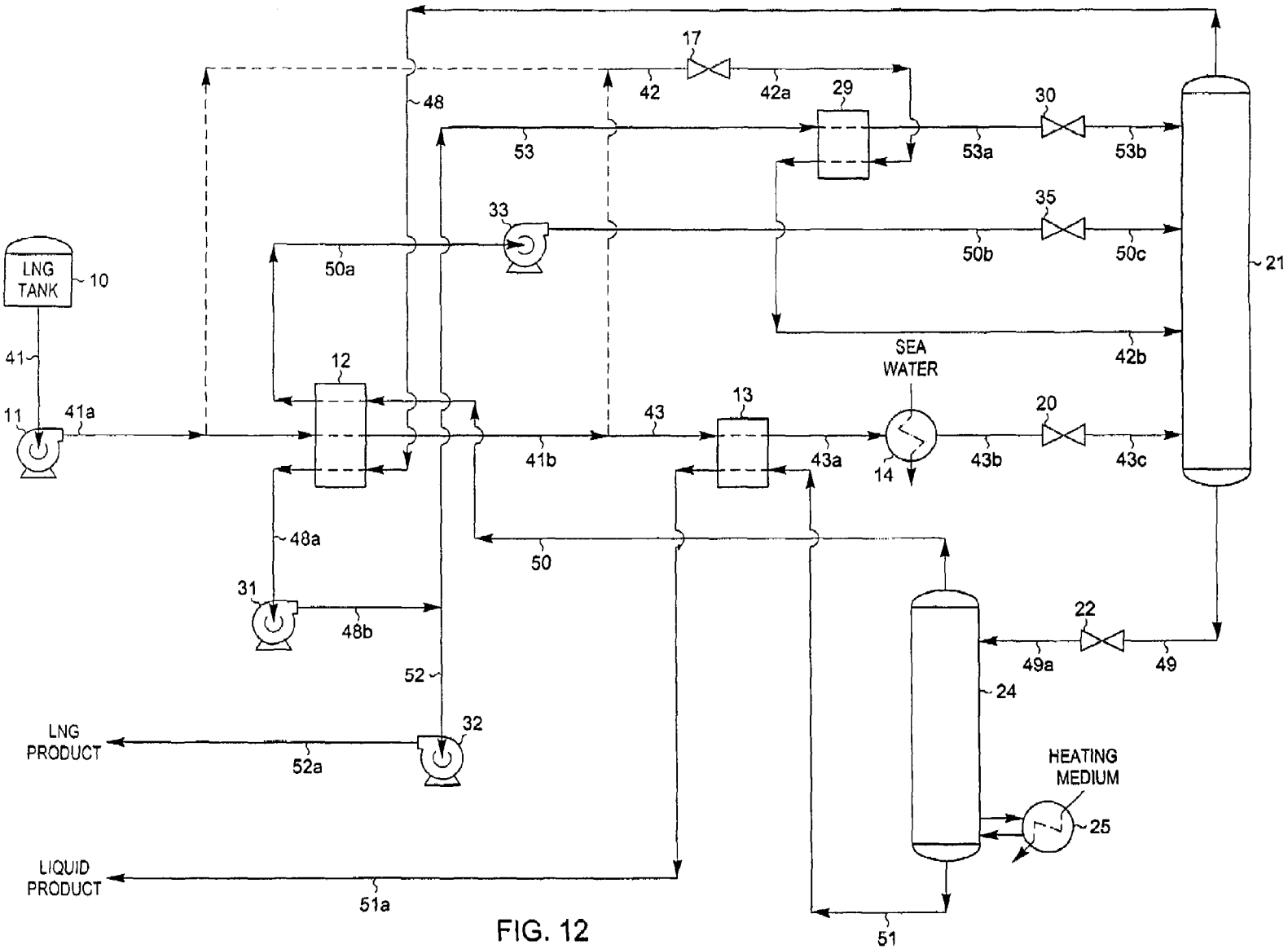

Some circumstances may favor subcooling reflux stream 53 with another process stream, rather than using the cold LNG stream that enters heat exchanger 12. In such circumstances, alternative embodiments of the present invention such as that shown in FIGS. 11 through 13 could be employed. In the FIGS. 11 and 12 embodiments, a portion (stream 42) of partially heated LNG stream 41*b* leaving heat exchanger 12 is expanded to slightly above the operating pressure of fractionation tower 21 (FIG. 11) or absorber column 21 (FIG. 12) by expansion valve 17 and the expanded stream 42*a* is directed into heat exchanger 29 to be heated as it provides subcooling of reflux stream 53. The subcooled reflux stream 53*a* is then expanded to the operating pressure of fractionation tower 21 (FIG. 11) or contacting and separating device absorber column 21 (FIG. 12) by expansion valve 30 and the expanded stream 53*b* supplied as cold top column feed (reflux) to fractionation tower 21 (FIG. 11) or absorber column 21 (FIG. 12). The heated stream 42*b* leaving heat exchanger 29 is supplied to the tower at a mid-column feed point where it serves as a supplemental reflux stream. Alternatively, as shown by the dashed lines in FIGS. 11 and 12, stream 42 may be withdrawn from LNG stream 41*a* before it enters heat exchanger 12. In the FIG. 13 embodiment, the supplemental reflux stream produced by condensing overhead vapor stream 50 from fractionation stripper column 24 is used to subcool reflux stream 53 in heat exchanger 29 by expanding stream 50*b* to slightly above the operating pressure of absorber column 21 with control valve 17 and directing the expanded stream 50*c* into heat exchanger 29. The heated stream 50*d* is then supplied to the tower at a mid-column feed point.

The decision regarding whether or not to subcool reflux stream 53 before it is expanded to the column operating pressure will depend on many factors, including the LNG composition, the desired recovery level, etc. As shown by the dashed lines in FIGS. 3 through 10, stream 53 can be routed to heat exchanger 12 if subcooling is desired, or routed directly to expansion valve 30 if no subcooling is desired. Likewise, heating of supplemental reflux stream 42 before it is expanded to the column operating pressure must be evaluated for each application. As shown by the dashed lines in FIGS. 3, 6, and 13, stream 42 can be withdrawn prior to heating of LNG stream 41*a* and routed directly to expansion valve 17 if no heating is desired, or withdrawn from the partially heated LNG stream 41*b* and routed to expansion valve 17 if heating is desired. On the other hand, heating and partial vaporization of supplemental reflux stream 50*b* as shown in FIG. 8 may not be advantageous, since this reduces the amount of liquid entering absorber column 21 that is used to capture the $C_2$ components and/or $C_3$ components and the heavier hydrocarbon components in the vapors rising upward from the lower section of absorber column 21. Instead, as shown by the dashed line in FIG. 8, stream 50*b* can be routed directly to expansion valve 35 and thence into absorber column 21.

When the LNG to be processed is leaner or when complete vaporization of the LNG in heat exchangers 12, 13, and 14 is contemplated, separator 15 in FIGS. 3 through 5 and 9 through 11 may not be justified. Depending on the quantity of heavier hydrocarbons in the inlet LNG and the pressure of the LNG stream leaving feed pump 11, the heated LNG stream leaving heat exchanger 14 in may not contain any liquid (because it is above its dewpoint, or because it is above its cricondenbar). In such cases, separator 15 and expansion valve 20 may be eliminated as shown by the dashed lines.

In the examples shown, total condensation of stream 48*a* in FIGS. 3, 5, and 9 through 11, stream 48*b* in FIG. 4, stream 48 in FIGS. 6 through 8, 12, and 13, stream 50 in FIGS. 6, 8, 10, 12, and 13, and stream 50*a* in FIGS. 7 and 9 is shown. Some circumstances may favor subcooling either or both of these streams, while other circumstances may favor only partial condensation. Should partial condensation of either or both streams be used, processing of the uncondensed vapor may be necessary, using a compressor or other means to elevate the pressure of the vapor so that it can join the pumped condensed liquid. Alternatively, the uncondensed vapor could be routed to the plant fuel system or other such use.

LNG conditions, plant size, available equipment, or other factors may indicate that elimination of work expansion machine 18 in FIGS. 3 through 5 and 9 through 11, or replacement with an alternate expansion device (such as an expansion valve), is feasible. Although individual stream expansion is depicted in particular expansion devices, alternative expansion means may be employed where appropriate.

Figure 13:
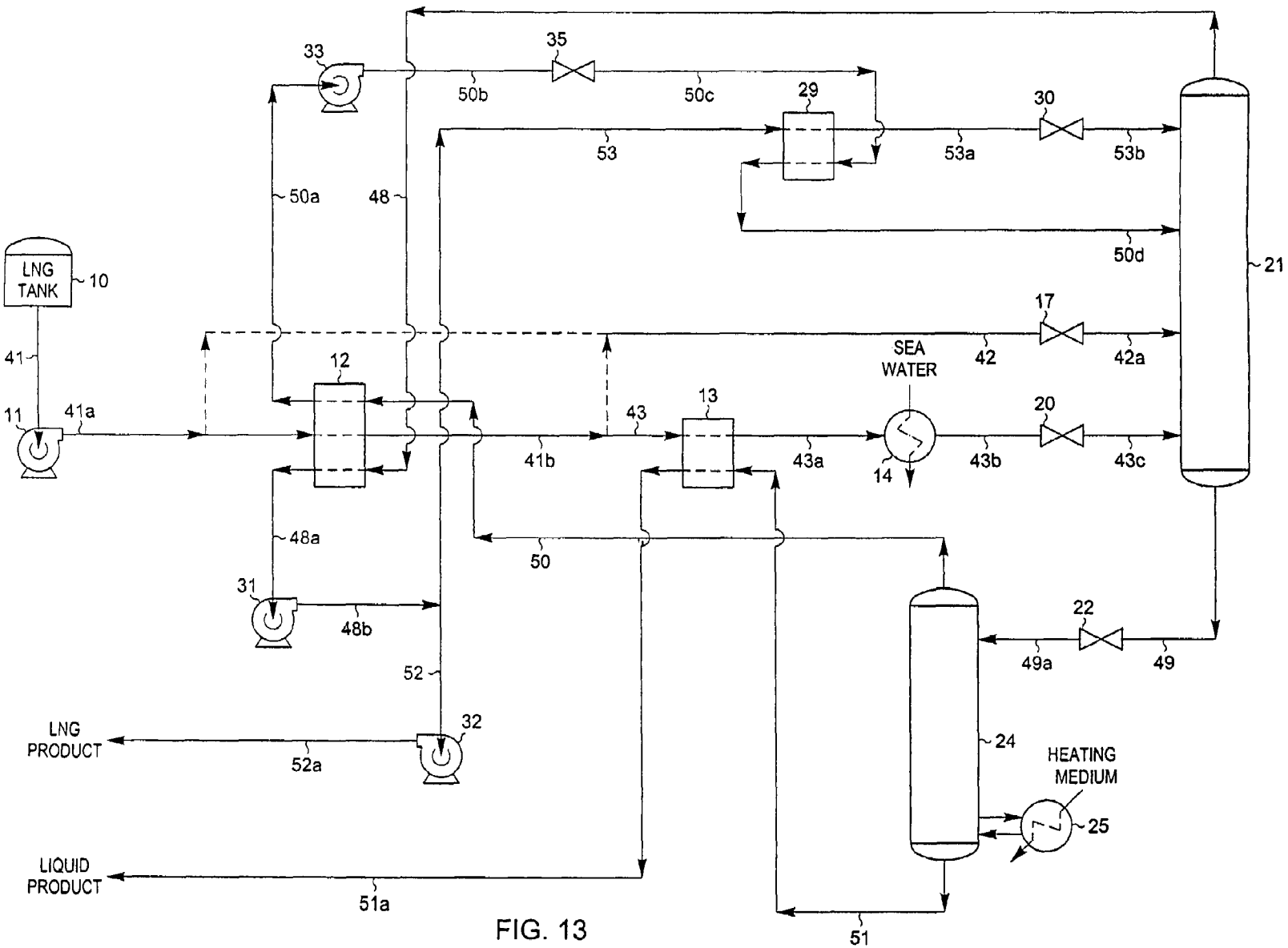

It also should be noted that expansion valves 17, 20, 22, 30, and/or 35 could be replaced with expansion engines (turboexpanders) whereby work could be extracted from the pressure reduction of stream 42 in FIGS. 3, 6, and 11 through 13, stream 45*a* in FIG. 4, stream 47 in FIGS. 3 through 5 and 9 through 11, stream 43*b* in FIGS. 6, 12, and 13, stream 41*d* in FIGS. 7 and 8, stream 49 in FIGS. 6 through 9, 12, and 13, stream 53*a* in FIGS. 3 through 5 and 11 through 13, stream 53 in FIGS. 6 through 10, stream 50*b* in FIGS. 6, 7, 9, 12, and 13, stream 50*c* in FIG. 8, and/or stream 50*a* in FIG. 10. In such cases, the LNG (stream 41) and/or other liquid streams may need to be pumped to a higher pressure so that work extraction is feasible. This work could be used to provide power for pumping the LNG feed stream, for pumping the lean LNG product stream, for compression of overhead vapor streams, or to generate electricity. The choice between use of valves or expansion engines will depend on the particular circumstances of each LNG processing project.

In FIGS. 3 through 13, individual heat exchangers have been shown for most services. However, it is possible to combine two or more heat exchange services into a common heat exchanger, such as combining heat exchangers 12, 13, and 14 in FIGS. 3 through 13 into a common heat exchanger. In some cases, circumstances may favor splitting a heat exchange service into multiple exchangers. The decision as to whether to combine heat exchange services or to use more than one heat exchanger for the indicated service will depend on a number of factors including, but not limited to, LNG flow rate, heat exchanger size, stream temperatures, etc.

It will be recognized that the relative amount of feed found in each branch of the split LNG feed to fractionation column 21 or absorber column 21 will depend on several factors, including LNG composition, the amount of heat which can economically be extracted from the feed, and the quantity of horsepower available. More feed to the top of the column may increase recovery while increasing the duty in reboiler 25 and thereby increasing the high level utility heat requirements. Increasing feed lower in the column reduces the high level utility heat consumption but may also reduce product recovery. The relative locations of the mid-column feeds may vary depending on LNG composition or other factors such as the desired recovery level and the amount of vapor formed during heating of the feed streams. Moreover, two or more of the feed streams, or portions thereof, may be combined depending on the relative temperatures and quantities of individual streams, and the combined stream then fed to a mid-column feed position.

In the examples given for the FIGS. 3 through 6 embodiments, recovery of $C_2$ components and heavier hydrocarbon components is illustrated, while recovery of $C_3$ components and heavier hydrocarbon components is illustrated in the examples given for the FIGS. 7 through 10 embodiments. However, it is believed that the FIGS. 3 through 6 embodiments are also advantageous when recovery of only $C_3$ components and heavier hydrocarbon components is desired, and that the FIGS. 7 through 10 embodiments are also advantageous when recovery of $C_2$ components and heavier hydrocarbon components is desired. Likewise, it is believed that the FIGS. 11 through 13 embodiments are advantageous both for recovery of $C_2$ components and heavier hydrocarbon components and for recovery of $C_3$ components and heavier hydrocarbon components.

The present invention provides improved recovery of $C_2$ components and heavier hydrocarbon components or of $C_3$ components and heavier hydrocarbon components per amount of utility consumption required to operate the process. An improvement in utility consumption required for operating the process may appear in the form of reduced power requirements for compression or pumping, reduced energy requirements for tower reboilers, or a combination thereof. Alternatively, the advantages of the present invention may be realized by accomplishing higher recovery levels for a given amount of utility consumption, or through some combination of higher recovery and improvement in utility consumption.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is divided into at least a first stream and a second stream;

(b) said first stream is expanded to lower pressure and is thereafter supplied to a fractionation column at an upper mid-column feed position;

(c) said second stream is heated sufficiently to partially vaporize it, thereby forming a vapor stream and a liquid stream;

(d) said vapor stream is expanded to said lower pressure and is supplied to said fractionation column at a first lower mid-column feed position;

(e) said liquid stream is expanded to said lower pressure and is supplied to said fractionation column at a second lower mid-column feed position;

(f) a vapor distillation stream is withdrawn from an upper region of said fractionation column and compressed;

(g) said compressed vapor distillation stream is cooled sufficiently to at least partially condense it and form thereby a condensed stream, with said cooling supplying at least a portion of said heating of said second stream;

(h) said condensed stream is divided into at least said volatile liquid fraction containing a major portion of said methane and a reflux stream;

(i) said reflux stream is supplied to said fractionation column at a top column feed position; and (j) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

2. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated and is thereafter divided into at least a first stream and a second stream;

(b) said first stream is expanded to lower pressure and is thereafter supplied to a fractionation column at an upper mid-column feed position;

(c) said second stream is heated sufficiently to partially vaporize it, thereby forming a vapor stream and a liquid stream;

(d) said vapor stream is expanded to said lower pressure and is supplied to said fractionation column at a first lower mid-column feed position;

(e) said liquid stream is expanded to said lower pressure and is supplied to said fractionation column at a second lower mid-column feed position;

(f) a vapor distillation stream is withdrawn from an upper region of said fractionation column and compressed;

(g) said compressed vapor distillation stream is cooled sufficiently to at least partially condense it and form thereby a condensed stream, with said cooling supplying at least a portion of said heating of said liquefied natural gas;

(h) said condensed stream is divided into at least said volatile liquid fraction containing a major portion of said methane and a reflux stream;

(i) said reflux stream is supplied to said fractionation column at a top column feed position; and (j) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

3. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is divided into at least a first stream and a second stream;

(b) said first stream is expanded to lower pressure and is thereafter supplied to a fractionation column at an upper mid-column feed position;

(c) said second stream is heated sufficiently to vaporize it, thereby forming a vapor stream;

(d) said vapor stream is expanded to said lower pressure and is supplied to said fractionation column at a lower mid-column feed position;

(e) a vapor distillation stream is withdrawn from an upper region of said fractionation column and compressed;

(f) said compressed vapor distillation stream is cooled sufficiently to at least partially condense it and form thereby a condensed stream, with said cooling supplying at least a portion of said heating of said second stream;

(g) said condensed stream is divided into at least said volatile liquid fraction containing a major portion of said methane and a reflux stream;

(h) said reflux stream is supplied to said fractionation column at a top column feed position; and (i) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

4. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated and is thereafter divided into at least a first stream and a second stream;

(b) said first stream is expanded to lower pressure and is thereafter supplied to a fractionation column at an upper mid-column feed position;

(c) said second stream is heated sufficiently to vaporize it, thereby forming a vapor stream;

(d) said vapor stream is expanded to said lower pressure and is supplied to said fractionation column at a lower mid-column feed position;

(e) a vapor distillation stream is withdrawn from an upper region of said fractionation column and compressed;

(f) said compressed vapor distillation stream is cooled sufficiently to at least partially condense it and form thereby a condensed stream, with said cooling supplying at least a portion of said heating of said liquefied natural gas;

(g) said condensed stream is divided into at least said volatile liquid fraction containing a major portion of said methane and a reflux stream;

(h) said reflux stream is supplied to said fractionation column at a top column feed position; and (i) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

5. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to partially vaporize it, thereby forming a vapor stream and a liquid stream;

(b) said vapor stream is divided into at least a first stream and a second stream;

(c) said first stream is cooled to condense substantially all of it and is thereafter expanded to lower pressure whereby it is further cooled;

(d) said expanded cooled first stream is supplied to a fractionation column at an upper mid-column feed position;

(e) said second stream is expanded to said lower pressure and is supplied to said fractionation column at a first lower mid-column feed position;

(f) said liquid stream is expanded to said lower pressure and is supplied to said fractionation column at a second lower mid-column feed position;

(g) a vapor distillation stream is withdrawn from an upper region of said fractionation column and heated, with said heating supplying at least a portion of said cooling of said first stream;

(h) said heated vapor distillation stream is compressed;

(i) said compressed heated vapor distillation stream is cooled sufficiently to at least partially condense it and form thereby a condensed stream, with said cooling supplying at least a portion of said heating of said liquefied natural gas;

(j) said condensed stream is divided into at least said volatile liquid fraction containing a major portion of said methane and a reflux stream;

(k) said reflux stream is supplied to said fractionation column at a top column feed position; and (l) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

6. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to vaporize it, thereby forming a vapor stream;

(b) said vapor stream is divided into at least a first stream and a second stream;

(c) said first stream is cooled to condense substantially all of it and is thereafter expanded to lower pressure whereby it is further cooled;

(d) said expanded cooled first stream is supplied to a fractionation column at an upper mid-column feed position;

(e) said second stream is expanded to said lower pressure and is supplied to said fractionation column at a lower mid-column feed position;

(f) a vapor distillation stream is withdrawn from an upper region of said fractionation column and heated, with said heating supplying at least a portion of said cooling of said first stream;

(g) said heated vapor distillation stream is compressed;

(h) said compressed heated vapor distillation stream is cooled sufficiently to at least partially condense it and form thereby a condensed stream, with said cooling supplying at least a portion of said heating of said liquefied natural gas;

(i) said condensed stream is divided into at least said volatile liquid fraction containing a major portion of said methane and a reflux stream;

(j) said reflux stream is supplied to said fractionation column at a top column feed position; and (k) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

7. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to partially vaporize it, thereby forming a vapor stream and a liquid stream;

(b) said vapor stream is expanded to lower pressure and is thereafter supplied to a fractionation column at a first mid-column feed position;

(c) said liquid stream is expanded to said lower pressure and is supplied to said fractionation column at a second mid-column feed position;

(d) a vapor distillation stream is withdrawn from an upper region of said fractionation column and compressed;

(e) said compressed vapor distillation stream is cooled sufficiently to at least partially condense it and form thereby a condensed stream, with said cooling supplying at least a portion of said heating of said liquefied natural gas;

(f) said condensed stream is divided into at least said volatile liquid fraction containing a major portion of said methane and a reflux stream;

(g) said reflux stream is supplied to said fractionation column at a top column feed position; and (h) the quantity and temperature of said reflux stream and the temperatures of said feeds to said fractionation column are effective to maintain the overhead temperature of said fractionation column at a temperature whereby the major portion of said heavier hydrocarbon components is recovered by fractionation in said relatively less volatile liquid fraction.

8. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to vaporize it, thereby forming a vapor stream;

(b) said vapor stream is expanded to lower pressure and is thereafter supplied to a fractionation column at a mid-column feed position;

(c) a vapor distillation stream is withdrawn from an upper region of said fractionation column and compressed;

(d) said compressed vapor distillation stream is cooled sufficiently to at least partially condense it and form thereby a condensed stream, with said cooling supplying at least a portion of said heating of said liquefied natural gas;

(e) said condensed stream is divided into at least said volatile liquid fraction containing a major portion of said methane and a reflux stream;

(f) said reflux stream is supplied to said fractionation column at a top column feed position; and (g) the quantity and temperature of said reflux stream and the temperature of said feed to said fractionation column are effective to maintain the overhead temperature of said fractionation column at a temperature whereby the major portion of said heavier hydrocarbon components is recovered by fractionation in said relatively less volatile liquid fraction.

9. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is divided into at least a first stream and a second stream;

(b) said first stream is expanded to lower pressure and is thereafter supplied at a first mid-column feed position to an absorber column that produces an overhead vapor stream and a bottom liquid stream;

(c) said second stream is heated sufficiently to at least partially vaporize it;

(d) said heated second stream is expanded to said lower pressure and is supplied to said absorber column at a lower feed position;

(e) said bottom liquid stream is supplied to a fractionation stripper column at a top column feed position;

(f) a vapor distillation stream is withdrawn from an upper region of said fractionation stripper column and cooled to condense substantially all of it, with said cooling supplying at least a portion of said heating of said second stream;

(g) said substantially condensed stream is pumped and is thereafter supplied to said absorber column at a second mid-column feed position;

(h) said overhead vapor stream is cooled sufficiently to at least partially condense it and form thereby a condensed stream, with said cooling supplying at least a portion of said heating of said second stream;

(i) said condensed stream is pumped and is thereafter divided into at least said volatile liquid fraction containing a major portion of said methane and a reflux stream;

(j) said reflux stream is supplied to said absorber column at a top column feed position; and (k) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

10. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated and is thereafter divided into at least a first stream and a second stream;

(b) said first stream is expanded to lower pressure and is thereafter supplied at a first mid-column feed position to an absorber column that produces an overhead vapor stream and a bottom liquid stream;

(c) said second stream is heated sufficiently to at least partially vaporize it;

(d) said heated second stream is expanded to said lower pressure and is supplied to said absorber column at a lower feed position;

(e) said bottom liquid stream is supplied to a fractionation stripper column at a top column feed position;

(f) a vapor distillation stream is withdrawn from an upper region of said fractionation stripper column and cooled to condense substantially all of it, with said cooling supplying at least a portion of said heating of said liquefied natural gas;

(g) said substantially condensed stream is pumped and is thereafter supplied to said absorber column at a second mid-column feed position;

(h) said overhead vapor stream is cooled sufficiently to at least partially condense it and form thereby a condensed stream, with said cooling supplying at least a portion of said heating of said liquefied natural gas;

(i) said condensed stream is pumped and is thereafter divided into at least said volatile liquid fraction containing a major portion of said methane and a reflux stream;

(j) said reflux stream is supplied to said absorber column at a top column feed position; and (k) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

11. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to at least partially vaporize it;

(b) said heated liquefied natural gas is expanded to lower pressure and is thereafter supplied at a lower feed position to an absorber column that produces an overhead vapor stream and a bottom liquid stream;

(c) said bottom liquid stream is supplied to a fractionation stripper column at a top column feed position;

(d) a vapor distillation stream is withdrawn from an upper region of said fractionation stripper column and compressed;

(e) said compressed vapor distillation stream is cooled sufficiently to at least partially condense it, with said cooling supplying at least a portion of said heating of said liquefied natural gas;

(f) said cooled compressed stream is supplied to said absorber column at a mid-column feed position;

(g) said overhead vapor stream is cooled sufficiently to at least partially condense it and form thereby a condensed stream, with said cooling supplying at least a portion of said heating of said liquefied natural gas;

(h) said condensed stream is pumped and is thereafter divided into at least said volatile liquid fraction containing a major portion of said methane and a reflux stream;

(i) said reflux stream is supplied to said absorber column at a top column feed position; and (j) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

12. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to at least partially vaporize it;

(b) said heated liquefied natural gas is expanded to lower pressure and is thereafter supplied at a lower feed position to an absorber column that produces an overhead vapor stream and a bottom liquid stream;

(c) said bottom liquid stream is supplied to a fractionation stripper column at a top column feed position;

(d) a vapor distillation stream is withdrawn from an upper region of said fractionation stripper column and cooled to condense substantially all of it, with said cooling supplying at least a portion of said heating of said liquefied natural gas;

(e) said substantially condensed stream is pumped and is thereafter supplied to said absorber column at a mid-column feed position;

(f) said overhead vapor stream is cooled sufficiently to at least partially condense it and form thereby a condensed stream, with said cooling supplying at least a portion of said heating of said liquefied natural gas;

(g) said condensed stream is pumped and is thereafter divided into at least said volatile liquid fraction containing a major portion of said methane and a reflux stream;

(h) said reflux stream is supplied to said absorber column at a top column feed position; and (i) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

13. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to partially vaporize it, thereby forming a vapor stream and a liquid stream;

(b) said vapor stream is expanded to lower pressure and is thereafter supplied at a first lower feed position to an absorber column that produces an overhead vapor stream and a bottom liquid stream;

(c) said liquid stream is expanded to said lower pressure and is supplied to said absorber column at a second lower feed position;

(d) said bottom liquid stream is supplied to a fractionation stripper column at a top column feed position;

(e) a vapor distillation stream is withdrawn from an upper region of said fractionation stripper column and compressed;

(f) said compressed vapor distillation stream is cooled sufficiently to at least partially condense it, with said cooling supplying at least a portion of said heating of said liquefied natural gas;

(g) said cooled compressed stream is supplied to said absorber column at a mid-column feed position;

(h) said overhead vapor stream is compressed;

(i) said compressed overhead vapor stream is cooled sufficiently to at least partially condense it and form thereby a condensed stream, with said cooling supplying at least a portion of said heating of said liquefied natural gas;

(j) said condensed stream is divided into at least said volatile liquid fraction containing a major portion of said methane and a reflux stream;

(k) said reflux stream is supplied to said absorber column at a top column feed position; and (l) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

14. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to at least partially vaporize it;

(b) said heated liquefied natural gas is expanded to lower pressure and is thereafter supplied at a lower feed position to an absorber column that produces an overhead vapor stream and a bottom liquid stream;

(c) said bottom liquid stream is supplied to a fractionation stripper column at a top column feed position;

(d) a vapor distillation stream is withdrawn from an upper region of said fractionation stripper column and compressed;

(e) said compressed vapor distillation stream is cooled sufficiently to at least partially condense it, with said cooling supplying at least a portion of said heating of said liquefied natural gas;

(f) said cooled compressed stream is supplied to said absorber column at a mid-column feed position;

(g) said overhead vapor stream is compressed;

(h) said compressed overhead vapor stream is cooled sufficiently to at least partially condense it and form thereby a condensed stream, with said cooling supplying at least a portion of said heating of said liquefied natural gas;

(i) said condensed stream is divided into at least said volatile liquid fraction containing a major portion of said methane and a reflux stream;

(j) said reflux stream is supplied to said absorber column at a top column feed position; and (k) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

15. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to partially vaporize it, thereby forming a vapor stream and a liquid stream;

(b) said vapor stream is expanded to lower pressure and is thereafter supplied at a first lower feed position to an absorber column that produces an overhead vapor stream and a bottom liquid stream;

(c) said liquid stream is expanded to said lower pressure and is supplied to said absorber column at a second lower feed position;

(d) said bottom liquid stream is pumped and is thereafter supplied to a fractionation stripper column at a top column feed position;

(e) a vapor distillation stream is withdrawn from an upper region of said fractionation stripper column and cooled sufficiently to at least partially condense it, with said cooling supplying at least a portion of said heating of said liquefied natural gas;

(f) said cooled distillation stream is supplied to said absorber column at a mid-column feed position;

(g) said overhead vapor stream is compressed;

(h) said compressed overhead vapor stream is cooled sufficiently to at least partially condense it and form thereby a condensed stream, with said cooling supplying at least a portion of said heating of said liquefied natural gas;

(i) said condensed stream is divided into at least said volatile liquid fraction containing a major portion of said methane and a reflux stream;

(j) said reflux stream is supplied to said absorber column at a top column feed position; and (k) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

16. A process for the separation of liquefied natural gas containing methane and heavier hydrocarbon components into a volatile liquid fraction containing a major portion of said methane and a relatively less volatile liquid fraction containing a major portion of said heavier hydrocarbon components wherein (a) said liquefied natural gas is heated sufficiently to at least partially vaporize it;

(b) said heated liquefied natural gas is expanded to lower pressure and is thereafter supplied at a lower feed position to an absorber column that produces an overhead vapor stream and a bottom liquid stream;

(c) said bottom liquid stream is pumped and is thereafter supplied to a fractionation stripper column at a top column feed position;

(d) a vapor distillation stream is withdrawn from an upper region of said fractionation stripper column and cooled sufficiently to at least partially condense it, with said cooling supplying at least a portion of said heating of said liquefied natural gas;

(e) said cooled distillation stream is supplied to said absorber column at a mid-column feed position;

(f) said overhead vapor stream is compressed;

(g) said compressed overhead vapor stream is cooled sufficiently to at least partially condense it and form thereby a condensed stream, with said cooling supplying at least a portion of said heating of said liquefied natural gas;

(h) said condensed stream is divided into at least said volatile liquid fraction containing a major portion of said methane and a reflux stream;

(i) said reflux stream is supplied to said absorber column at a top column feed position; and (j) the quantity and temperature of said reflux stream and the temperatures of said feeds to said absorber column and said fractionation stripper column are effective to maintain the overhead temperatures of said absorber column and said fractionation stripper column at temperatures whereby the major portion of said heavier hydrocarbon components is recovered by fractionation in said relatively less volatile liquid fraction.

17. The process according to claim 1 or 3 wherein said reflux stream is further cooled and is thereafter supplied to said fractionation column at said top column feed position, with said cooling supplying at least a portion of said heating of said second stream.

18. The process according to claim 2, 4, 5, 6, 7, or 8 wherein said reflux stream is further cooled and is thereafter supplied to said fractionation column at said top column feed position, with said cooling supplying at least a portion of said heating of said liquefied natural gas.

19. The process according to claim 9 wherein said reflux stream is further cooled and is thereafter supplied to said absorber column at said top column feed position, with said cooling supplying at least a portion of said heating of said second stream.

20. The process according to claim 10, 11, 12, 13, 14, 15, or 16 wherein said reflux stream is further cooled and is thereafter supplied to said absorber column at said top column feed position, with said cooling supplying at least a portion of said heating of said liquefied natural gas.

21. The process according to claim 12 wherein said pumped substantially condensed stream is heated and is thereafter supplied to said absorber column at said mid-column feed position, with said heating supplying at least a portion of said cooling of said vapor distillation stream or said overhead vapor stream.

22. The process according to claim 21 wherein said reflux stream is further cooled and is thereafter supplied to said absorber column at said top column feed position, with said cooling supplying at least a portion of said heating of said liquefied natural gas.

23. The process according to claim 1, 2, 3, or 4 wherein (a) said reflux stream is further cooled and is thereafter supplied to said fractionation column at said top column feed position;

(b) said first stream is expanded to said lower pressure and is thereafter heated, with said heating supplying at least a portion of said further cooling of said reflux stream; and (c) said heated expanded first stream is supplied to said fractionation column at said upper mid-column feed position.

24. The process according to claim 9 or 10 wherein (a) said reflux stream is further cooled and is thereafter supplied to said absorber column at said top column feed position;

(b) said first stream is expanded to said lower pressure and is thereafter heated, with said heating supplying at least a portion of said further cooling of said reflux stream; and (c) said heated expanded first stream is supplied to said absorber column at said first mid-column feed position.

25. The process according to claim 9 or 10 wherein (a) said reflux stream is further cooled and is thereafter supplied to said absorber column at said top column feed position;

(b) said substantially condensed stream is pumped and is thereafter heated, with said heating supplying at least a portion of said further cooling of said reflux stream; and (c) said heated pumped substantially condensed stream is supplied to said absorber column at said second mid-column feed position.

26. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) first dividing means connected to receive said liquefied natural gas and divide it into at least a first stream and a second stream;

(b) first expansion means connected to said first dividing means to receive said first stream and expand it to lower pressure, said first expansion means being further connected to a fractionation column to supply said expanded first stream at an upper mid-column feed position;

(c) heat exchange means connected to said first dividing means to receive said second stream and heat it sufficiently to partially vaporize it;

(d) separation means connected to said heat exchange means to receive said heated partially vaporized second stream and separate it into a vapor stream and a liquid stream;

(e) second expansion means connected to said separation means to receive said vapor stream and expand it to said lower pressure, said second expansion means being further connected to said fractionation column to supply said expanded vapor stream at a first lower mid-column feed position;

(f) third expansion means connected to said separation means to receive said liquid stream and expand it to said lower pressure, said third expansion means being further connected to said fractionation column to supply said expanded liquid stream at a second lower mid-column feed position;

(g) withdrawing means connected to an upper region of said fractionation column to withdraw a vapor distillation stream;

(h) compressing means connected to said withdrawing means to receive said vapor distillation stream and compress it;

(i) said heat exchange means further connected to said compressing means to receive said compressed vapor distillation stream and cool it sufficiently to at least partially condense it and form thereby a condensed steam, with said cooling supplying at least a portion of said heating of said second stream;

(j) second dividing means connected to said heat exchange means to receive said condensed stream and divide it into at least said volatile liquid fraction containing a major portion of said methane and a reflux stream, said second dividing means being further connected to said fractionation column to supply said reflux stream to said fractionation column at a top column feed position; and (k) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

27. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it;

(b) first dividing means connected to said heat exchange means receive said heated liquefied natural gas and divide it into at least a first stream and a second stream;

(c) first expansion means connected to said first dividing means to receive said first stream and expand it to lower pressure, said first expansion means being further connected to a fractionation column to supply said expanded first stream at an upper mid-column feed position;

(d) heating means connected to said first dividing means to receive said second stream and heat it sufficiently to partially vaporize it;

(e) separation means connected to said heating means to receive said heated partially vaporized second stream and separate it into a vapor stream and a liquid stream;

(f) second expansion means connected to said separation means to receive said vapor stream and expand it to said lower pressure, said second expansion means being further connected to said fractionation column to supply said expanded vapor stream at a first lower mid-column feed position;

(g) third expansion means connected to said separation means to receive said liquid stream and expand it to said lower pressure, said third expansion means being further connected to said fractionation column to supply said expanded liquid stream at a second lower mid-column feed position;

(h) withdrawing means connected to an upper region of said fractionation column to withdraw a vapor distillation stream;

(i) compressing means connected to said withdrawing means to receive said vapor distillation stream and compress it;

(j) said heat exchange means further connected to said compressing means to receive said compressed vapor distillation stream and cool it sufficiently to at least partially condense it and form thereby a condensed steam, with said cooling supplying at least a portion of said heating of said liquefied natural gas;

(k) second dividing means connected to said heat exchange means to receive said condensed stream and divide it into at least said volatile liquid fraction containing a major portion of said methane and a reflux stream, said second dividing means being further connected to said fractionation column to supply said reflux stream to said fractionation column at a top column feed position; and (l) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

28. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) first dividing means connected to receive said liquefied natural gas and divide it into at least a first stream and a second stream;

(b) first expansion means connected to said first dividing means to receive said first stream and expand it to lower pressure, said first expansion means being further connected to a fractionation column to supply said expanded first stream at an upper mid-column feed position;

(c) heat exchange means connected to said first dividing means to receive said second stream and heat it sufficiently to vaporize it, thereby forming a vapor stream;

(d) second expansion means connected to said heat exchange means to receive said vapor stream and expand it to said lower pressure, said second expansion means being further connected to said fractionation column to supply said expanded vapor stream at a lower mid-column feed position;

(e) withdrawing means connected to an upper region of said fractionation column to withdraw a vapor distillation stream;

(f) compressing means connected to said withdrawing means to receive said vapor distillation stream and compress it;

(g) said heat exchange means further connected to said compressing means to receive said compressed vapor distillation stream and cool it sufficiently to at least partially condense it and form thereby a condensed steam, with said cooling supplying at least a portion of said heating of said second stream;

(h) second dividing means connected to said heat exchange means to receive said condensed stream and divide it into at least said volatile liquid fraction containing a major portion of said methane and a reflux stream, said second dividing means being further connected to said fractionation column to supply said reflux stream to said fractionation column at a top column feed position; and (i) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

29. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it;

(b) first dividing means connected to said heat exchange means receive said heated liquefied natural gas and divide it into at least a first stream and a second stream;

(c) first expansion means connected to said first dividing means to receive said first stream and expand it to lower pressure, said first expansion means being further connected to a fractionation column to supply said expanded first stream at an upper mid-column feed position;

(d) heating means connected to said first dividing means to receive said second stream and heat it sufficiently to vaporize it, thereby forming a vapor stream;

(e) second expansion means connected to said heating means to receive said vapor stream and expand it to said lower pressure, said second expansion means being further connected to said fractionation column to supply said expanded vapor stream at a lower mid-column feed position;

(f) withdrawing means connected to an upper region of said fractionation column to withdraw a vapor distillation stream;

(g) compressing means connected to said withdrawing means to receive said vapor distillation stream and compress it;

(h) said heat exchange means further connected to said compressing means to receive said compressed vapor distillation stream and cool it sufficiently to at least partially condense it and form thereby a condensed steam, with said cooling supplying at least a portion of said heating of said liquefied natural gas;

(i) second dividing means connected to said heat exchange means to receive said condensed stream and divide it into at least said volatile liquid fraction containing a major portion of said methane and a reflux stream, said second dividing means being further connected to said fractionation column to supply said reflux stream to said fractionation column at a top column feed position; and (j) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

30. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) first heat exchange means connected to receive said liquefied natural gas and heat it sufficiently to partially vaporize it;

(b) separation means connected to said first heat exchange means to receive said heated partially vaporized stream and separate it into a vapor stream and a liquid stream;

(c) first dividing means connected to said separation means receive said vapor stream and divide it into at least a first stream and a second stream;

(d) second heat exchange means connected to said first dividing means to receive said first stream and to cool it sufficiently to substantially condense it;

(e) first expansion means connected to said second heat exchange means to receive said substantially condensed first stream and expand it to lower pressure, said first expansion means being further connected to a fractionation column to supply said expanded first stream at an upper mid-column feed position;

(f) second expansion means connected to said first dividing means to receive said second stream and expand it to said lower pressure, said second expansion means being further connected to said fractionation column to supply said expanded vapor stream at a first lower mid-column feed position;

(g) third expansion means connected to said separation means to receive said liquid stream and expand it to said lower pressure, said third expansion means being further connected to said fractionation column to supply said expanded liquid stream at a second lower mid-column feed position;

(h) withdrawing means connected to an upper region of said fractionation column to withdraw a vapor distillation stream;

(i) said second heat exchange means further connected to said withdrawing means to receive said vapor distillation stream and heat it, with said heating supplying at least a portion of said cooling of said first stream;

(j) compressing means connected to said second heat exchange means to receive said heated vapor distillation stream and compress it;

(k) said first heat exchange means further connected to said compressing means to receive said compressed heated vapor distillation stream and cool it sufficiently to at least partially condense it and form thereby a condensed steam, with said cooling supplying at least a portion of said heating of said liquefied natural gas;

(l) second dividing means connected to said first heat exchange means to receive said condensed stream and divide it into at least said volatile liquid fraction containing a major portion of said methane and a reflux stream, said second dividing means being further connected to said fractionation column to supply said reflux stream to said fractionation column at a top column feed position; and (m) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

31. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) first heat exchange means connected to receive said liquefied natural gas and heat it sufficiently to vaporize it, thereby forming a vapor stream;

(b) first dividing means connected to said first heat exchange means to receive said vapor stream and divide it into at least a first stream and a second stream;

(c) second heat exchange means connected to said first dividing means to receive said first stream and to cool it sufficiently to substantially condense it;

(d) first expansion means connected to said second heat exchange means to receive said substantially condensed first stream and expand it to lower pressure, said first expansion means being further connected to a fractionation column to supply said expanded first stream at an upper mid-column feed position;

(e) second expansion means connected to said first dividing means to receive said second stream and expand it to said lower pressure, said second expansion means being further connected to said fractionation column to supply said expanded vapor stream at a lower mid-column feed position;

(f) withdrawing means connected to an upper region of said fractionation column to withdraw a vapor distillation stream;

(g) said second heat exchange means further connected to said withdrawing means to receive said vapor distillation stream and heat it, with said heating supplying at least a portion of said cooling of said first stream;

(h) compressing means connected to said second heat exchange means to receive said heated vapor distillation stream and compress it;

(i) said first heat exchange means further connected to said compressing means to receive said compressed heated vapor distillation stream and cool it sufficiently to at least partially condense it and form thereby a condensed steam, with said cooling supplying at least a portion of said heating of said liquefied natural gas;

(j) second dividing means connected to said first heat exchange means to receive said condensed stream and divide it into at least said volatile liquid fraction containing a major portion of said methane and a reflux stream, said second dividing means being further connected to said fractionation column to supply said reflux stream to said fractionation column at a top column feed position; and (k) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

32. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to partially vaporize it;

(b) separation means connected to said heat exchange means to receive said heated partially vaporized stream and separate it into a vapor stream and a liquid stream;

(c) first expansion means connected to said separation means to receive said vapor stream and expand it to lower pressure, said first expansion means being further connected to a fractionation column to supply said expanded vapor stream at a first mid-column feed position;

(d) second expansion means connected to said separation means to receive said liquid stream and expand it to said lower pressure, said second expansion means being further connected to said fractionation column to supply said expanded liquid stream at a second mid-column feed position;

(e) withdrawing means connected to an upper region of said fractionation column to withdraw a vapor distillation stream;

(f) compressing means connected to said withdrawing means to receive said vapor distillation stream and compress it;

(g) said heat exchange means further connected to said compressing means to receive said compressed vapor distillation stream and cool it sufficiently to at least partially condense it and form thereby a condensed steam, with said cooling supplying at least a portion of said heating of said liquefied natural gas;

(h) dividing means connected to said heat exchange means to receive said condensed stream and divide it into at least said volatile liquid fraction containing a major portion of said methane and a reflux stream, said dividing means being further connected to said fractionation column to supply said reflux stream to said fractionation column at a top column feed position; and (i) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered by fractionation in said relatively less volatile liquid fraction.

33. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to vaporize it, thereby forming a vapor stream;

(b) expansion means connected to said heat exchange means to receive said vapor stream and expand it to lower pressure, said expansion means being further connected to a fractionation column to supply said expanded vapor stream at a mid-column feed position;

(c) withdrawing means connected to an upper region of said fractionation column to withdraw a vapor distillation stream;

(d) compressing means connected to said withdrawing means to receive said vapor distillation stream and compress it;

(e) said heat exchange means further connected to said compressing means to receive said compressed vapor distillation stream and cool it sufficiently to at least partially condense it and form thereby a condensed steam, with said cooling supplying at least a portion of said heating of said liquefied natural gas;

(f) dividing means connected to said heat exchange means to receive said condensed stream and divide it into at least said volatile liquid fraction containing a major portion of said methane and a reflux stream, said dividing means being further connected to said fractionation column to supply said reflux stream to said fractionation column at a top column feed position; and (g) control means adapted to regulate the quantity and temperature of said reflux stream and the temperature of said feed stream to said fractionation column to maintain the overhead temperature of said fractionation column at a temperature whereby the major portion of said heavier hydrocarbon components is recovered by fractionation in said relatively less volatile liquid fraction.

34. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) first dividing means connected to receive said liquefied natural gas and divide it into at least a first stream and a second stream;

(b) first expansion means connected to said first dividing means to receive said first stream and expand it to lower pressure, said first expansion means being further connected to supply said expanded first stream at a first mid-column feed position on an absorber column that produces an overhead vapor stream and a bottom liquid stream;

(c) heat exchange means connected to said first dividing means to receive said second stream and heat it sufficiently to at least partially vaporize it;

(d) second expansion means connected to said heat exchange means to receive said heated second stream and expand it to said lower pressure, said second expansion means being further connected to said absorber column to supply said expanded heated second stream at a lower feed position;

(e) a fractionation stripper column connected to said absorber column to receive said bottom liquid stream at a top column feed position;

(f) first withdrawing means connected to an upper region of said fractionation stripper column to withdraw a vapor distillation stream;

(g) said heat exchange means further connected to said first withdrawing means to receive said vapor distillation stream and cool it to condense substantially all of it, with said cooling supplying at least a portion of said heating of said second stream;

(h) first pumping means connected to said heat exchange means to receive said substantially condensed stream and pump it, said first pumping means being further connected to said absorber column to supply said pumped substantially condensed stream at a second mid-column feed position;

(i) second withdrawing means connected to an upper region of said absorber column to withdraw said overhead vapor stream;

(j) said heat exchange means further connected to said second withdrawing means to receive said overhead vapor stream and cool it sufficiently to at least partially condense it and form thereby a condensed steam, with said cooling supplying at least a portion of said heating of said second stream;

(k) second pumping means connected to said heat exchange means to receive said condensed stream and pump it;

(l) second dividing means connected to said second pumping means to receive said pumped condensed stream and divide it into at least said volatile liquid fraction containing a major portion of said methane and a reflux stream, said second dividing means being further connected to said absorber column to supply said reflux stream to said absorber column at a top column feed position; and (m) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

35. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it;

(b) first dividing means connected to said heat exchange means receive said heated liquefied natural gas and divide it into at least a first stream and a second stream;

(c) first expansion means connected to said first dividing means to receive said first stream and expand it to lower pressure, said first expansion means being further connected to supply said expanded first stream at a first mid-column feed position on an absorber column that produces an overhead vapor stream and a bottom liquid stream;

(d) heating means connected to said first dividing means to receive said second stream and heat it sufficiently to at least partially vaporize it;

(e) second expansion means connected to said heating means to receive said heated second stream and expand it to said lower pressure, said second expansion means being further connected to said absorber column to supply said expanded heated second stream at a lower feed position;

(f) a fractionation stripper column connected to said absorber column to receive said bottom liquid stream at a top column feed position;

(g) first withdrawing means connected to an upper region of said fractionation stripper column to withdraw a vapor distillation stream;

(h) said heat exchange means further connected to said first withdrawing means to receive said vapor distillation stream and cool it to condense substantially all of it, with said cooling supplying at least a portion of said heating of said liquefied natural gas;

(i) first pumping means connected to said heat exchange means to receive said substantially condensed stream and pump it, said first pumping means being further connected to said absorber column to supply said pumped substantially condensed stream at a second mid-column feed position;

(j) second withdrawing means connected to an upper region of said absorber column to withdraw said overhead vapor stream;

(k) said heat exchange means further connected to said second withdrawing means to receive said overhead vapor stream and cool it sufficiently to at least partially condense it and form thereby a condensed steam, with said cooling supplying at least a portion of said heating of said liquefied natural gas;

(l) second pumping means connected to said heat exchange means to receive said condensed stream and pump it;

(m) second dividing means connected to said second pumping means to receive said pumped condensed stream and divide it into at least said volatile liquid fraction containing a major portion of said methane and a reflux stream, said second dividing means being further connected to said absorber column to supply said reflux stream to said absorber column at a top column feed position; and (n) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

36. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to at least partially vaporize it;

(b) expansion means connected to said heat exchange means to receive said heated liquefied natural gas and expand it to lower pressure, said expansion means being further connected to supply said expanded heated liquefied natural gas at a lower feed position on an absorber column that produces an overhead vapor stream and a bottom liquid stream;

(c) a fractionation stripper column connected to said absorber column to receive said bottom liquid stream at a top column feed position;

(d) first withdrawing means connected to an upper region of said fractionation stripper column to withdraw a vapor distillation stream;

(e) compressing means connect to said first withdrawing means to receive said vapor distillation stream and compress it;

(f) said heat exchange means further connected to said compressing means to receive said compressed vapor distillation stream and cool it sufficiently to at least partially condense it, with said cooling supplying at least a portion of said heating of said liquefied natural gas, said heat exchange means being further connected to said absorber column to supply said cooled compressed stream at a mid-column feed position;

(g) second withdrawing means connected to an upper region of said absorber column to withdraw said overhead vapor stream;

(h) said heat exchange means further connected to said second withdrawing means to receive said overhead vapor stream and cool it sufficiently to at least partially condense it and form thereby a condensed steam, with said cooling supplying at least a portion of said heating of said liquefied natural gas;

(i) pumping means connected to said heat exchange means to receive said condensed stream and pump it;

(j) second dividing means connected to said pumping means to receive said pumped condensed stream and divide it into at least said volatile liquid fraction containing a major portion of said methane and a reflux stream, said second dividing means being further connected to said absorber column to supply said reflux stream to said absorber column at a top column feed position; and (k) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

37. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to at least partially vaporize it;

(b) expansion means connected to said heat exchange means to receive said heated liquefied natural gas and expand it to lower pressure, said expansion means being further connected to supply said expanded heated liquefied natural gas at a lower feed position on an absorber column that produces an overhead vapor stream and a bottom liquid stream;

(c) a fractionation stripper column connected to said absorber column to receive said bottom liquid stream at a top column feed position;

(d) first withdrawing means connected to an upper region of said fractionation stripper column to withdraw a vapor distillation stream;

(e) said heat exchange means further connected to said first withdrawing means to receive said vapor distillation stream and cool it to condense substantially all of it, with said cooling supplying at least a portion of said heating of said liquefied natural gas;

(f) first pumping means connected to said heat exchange means to receive said substantially condensed stream and pump it, said first pumping means being further connected to said absorber column to supply said pumped substantially condensed stream at a mid-column feed position;

(g) second withdrawing means connected to an upper region of said absorber column to withdraw said overhead vapor stream;

(h) said heat exchange means further connected to said second withdrawing means to receive said overhead vapor stream and cool it sufficiently to at least partially condense it and form thereby a condensed steam, with said cooling supplying at least a portion of said heating of said liquefied natural gas;

(i) second pumping means connected to said heat exchange means to receive said condensed stream and pump it;

(j) dividing means connected to said second pumping means to receive said pumped condensed stream and divide it into at least said volatile liquid fraction containing a major portion of said methane and a reflux stream, said dividing means being further connected to said absorber column to supply said reflux stream to said absorber column at a top column feed position; and (k) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

38. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to partially vaporize it;

(b) separation means connected to said heat exchange means to receive said heated partially vaporized stream and separate it into a vapor stream and a liquid stream;

(c) first expansion means connected to said separation means to receive said vapor stream and expand it to lower pressure, said first expansion means being further connected to supply said expanded vapor stream at a first lower feed position on an absorber column that produces an overhead vapor stream and a bottom liquid stream;

(d) second expansion means connected to said separation means to receive said liquid stream and expand it to said lower pressure, said second expansion means being further connected to said absorber column to supply said expanded liquid stream at a second lower feed position;

(e) a fractionation stripper column connected to said absorber column to receive said bottom liquid stream at a top column feed position;

(f) first withdrawing means connected to an upper region of said fractionation stripper column to withdraw a vapor distillation stream;

(g) first compressing means connect to said first withdrawing means to receive said vapor distillation stream and compress it;

(h) said heat exchange means further connected to said first compressing means to receive said compressed vapor distillation stream and cool it sufficiently to at least partially condense it, with said cooling supplying at least a portion of said heating of said liquefied natural gas, said heat exchange means being further connected to said absorber column to supply said cooled compressed stream at a mid-column feed position;

(i) second withdrawing means connected to an upper region of said absorber column to withdraw said overhead vapor stream;

(j) second compressing means connect to said second withdrawing means to receive said overhead vapor stream and compress it;

(k) said heat exchange means further connected to said second compressing means to receive said compressed overhead vapor stream and cool it sufficiently to at least partially condense it and form thereby a condensed steam, with said cooling supplying at least a portion of said heating of said liquefied natural gas;

(l) dividing means connected to said heat exchange means to receive said condensed stream and divide it into at least said volatile liquid fraction containing a major portion of said methane and a reflux stream, said dividing means being further connected to said absorber column to supply said reflux stream to said absorber column at a top column feed position; and (m) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

39. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to at least partially vaporize it;

(b) expansion means connected to said heat exchange means to receive said heated liquefied natural gas and expand it to lower pressure, said expansion means being further connected to supply said expanded heated liquefied natural gas at a lower feed position on an absorber column that produces an overhead vapor stream and a bottom liquid stream;

(c) a fractionation stripper column connected to said absorber column to receive said bottom liquid stream at a top column feed position;

(d) first withdrawing means connected to an upper region of said fractionation stripper column to withdraw a vapor distillation stream;

(e) first compressing means connect to said first withdrawing means to receive said vapor distillation stream and compress it;

(f) said heat exchange means further connected to said first compressing means to receive said compressed vapor distillation stream and cool it sufficiently to at least partially condense it, with said cooling supplying at least a portion of said heating of said liquefied natural gas, said heat exchange means being further connected to said absorber column to supply said cooled compressed stream at a mid-column feed position;

(g) second withdrawing means connected to an upper region of said absorber column to withdraw said overhead vapor stream;

(h) second compressing means connect to said second withdrawing means to receive said overhead vapor stream and compress it;

(i) said heat exchange means further connected to said second compressing means to receive said compressed overhead vapor stream and cool it sufficiently to at least partially condense it and form thereby a condensed steam, with said cooling supplying at least a portion of said heating of said liquefied natural gas;

(j) dividing means connected to said heat exchange means to receive said condensed stream and divide it into at least said volatile liquid fraction containing a major portion of said methane and a reflux stream, said dividing means being further connected to said absorber column to supply said reflux stream to said absorber column at a top column feed position; and (k) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

40. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to partially vaporize it;

(b) separation means connected to said heat exchange means to receive said heated partially vaporized stream and separate it into a vapor stream and a liquid stream;

(c) first expansion means connected to said separation means to receive said vapor stream and expand it to lower pressure, said first expansion means being further connected to supply said expanded vapor stream at a first lower feed position on an absorber column that produces an overhead vapor stream and a bottom liquid stream;

(d) second expansion means connected to said separation means to receive said liquid stream and expand it to said lower pressure, said second expansion means being further connected to said absorber column to supply said expanded liquid stream at a second lower feed position;

(e) pumping means connected to said absorber column to receive said bottom liquid stream and pump it;

(f) a fractionation stripper column connected to said pumping means to receive said pumped bottom liquid stream at a top column feed position;

(g) first withdrawing means connected to an upper region of said fractionation stripper column to withdraw a vapor distillation stream;

(h) said heat exchange means further connected to said first withdrawing means to receive said vapor distillation stream and cool it sufficiently to at least partially condense it, with said cooling supplying at least a portion of said heating of said liquefied natural gas, said heat exchange means being further connected to said absorber column to supply said cooled distillation stream at a mid-column feed position;

(i) second withdrawing means connected to an upper region of said absorber column to withdraw said overhead vapor stream;

(j) compressing means connect to said second withdrawing means to receive said overhead vapor stream and compress it;

(k) said heat exchange means further connected to said compressing means to receive said compressed overhead vapor stream and cool it sufficiently to at least partially condense it and form thereby a condensed steam, with said cooling supplying at least a portion of said heating of said liquefied natural gas;

(l) dividing means connected to said heat exchange means to receive said condensed stream and divide it into at least said volatile liquid fraction containing a major portion of said methane and a reflux stream, said dividing means being further connected to said absorber column to supply said reflux stream to said absorber column at a top column feed position; and (m) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

41. An apparatus for the separation of liquefied natural gas containing methane and heavier hydrocarbon components into a volatile liquid fraction containing a major portion of said methane and a relatively less volatile liquid fraction containing a major portion of said heavier hydrocarbon components comprising (a) heat exchange means connected to receive said liquefied natural gas and heat it sufficiently to at least partially vaporize it;

(b) expansion means connected to said heat exchange means to receive said heated liquefied natural gas and expand it to lower pressure, said expansion means being further connected to supply said expanded heated liquefied natural gas at a lower feed position on an absorber column that produces an overhead vapor stream and a bottom liquid stream;

(c) pumping means connected to said absorber column to receive said bottom liquid stream and pump it;

(d) a fractionation stripper column connected to said pumping means to receive said pumped bottom liquid stream at a top column feed position;

(e) first withdrawing means connected to an upper region of said fractionation stripper column to withdraw a vapor distillation stream;

(f) said heat exchange means further connected to said first withdrawing means to receive said vapor distillation stream and cool it sufficiently to at least partially condense it, with said cooling supplying at least a portion of said heating of said liquefied natural gas, said heat exchange means being further connected to said absorber column to supply said cooled distillation stream at a mid-column feed position;

(g) second withdrawing means connected to an upper region of said absorber column to withdraw said overhead vapor stream;

(h) compressing means connect to said second withdrawing means to receive said overhead vapor stream and compress it;

(i) said heat exchange means further connected to said compressing means to receive said compressed overhead vapor stream and cool it sufficiently to at least partially condense it and form thereby a condensed steam, with said cooling supplying at least a portion of said heating of said liquefied natural gas;

(j) dividing means connected to said heat exchange means to receive said condensed stream and divide it into at least said volatile liquid fraction containing a major portion of said methane and a reflux stream, said dividing means being further connected to said absorber column to supply said reflux stream to said absorber column at a top column feed position; and (k) control means adapted to regulate the quantity and temperature of said reflux stream and the temperatures of said feed streams to said absorber column and said fractionation stripper column to maintain the overhead temperatures of said absorber column and said fractionation stripper column at a temperature whereby the major portion of said heavier hydrocarbon components is recovered by fractionation in said relatively less volatile liquid fraction.

42. The apparatus according to claim 26 or 28 wherein said heat exchange means is further connected to said second dividing means to receive said reflux stream and further cool it, said heat exchange means being further connected to said fractionation column to supply said further cooled reflux stream at said top column feed position, with said cooling supplying at least a portion of said heating of said second stream.

43. The apparatus according to claim 27, 29, 30, or 31 wherein said heat exchange means is further connected to said second dividing means to receive said reflux stream and further cool it, said heat exchange means being further connected to said fractionation column to supply said further cooled reflux stream at said top column feed position, with said cooling supplying at least a portion of said heating of said liquefied natural gas.

44. The apparatus according to claim 32 or 33 wherein said heat exchange means is further connected to said dividing means to receive said reflux stream and further cool it, said heat exchange means being further connected to said fractionation column to supply said further cooled reflux stream at said top column feed position, with said cooling supplying at least a portion of said heating of said liquefied natural gas.

45. The apparatus according to claim 34 wherein said heat exchange means is further connected to said second dividing means to receive said reflux stream and further cool it, said heat exchange means being further connected to said absorber column to supply said further cooled reflux stream at said top column feed position, with said cooling supplying at least a portion of said heating of said second stream.

46. The apparatus according to claim 35 wherein said heat exchange means is further connected to said second dividing means to receive said reflux stream and further cool it, said heat exchange means being further connected to said absorber column to supply said further cooled reflux stream at said top column feed position, with said cooling supplying at least a portion of said heating of said liquefied natural gas.

47. The apparatus according to claim 36, 37, 38, 39, 40, or 41 wherein said heat exchange means is further connected to said dividing means to receive said reflux stream and further cool it, said heat exchange means being further connected to said absorber column to supply said further cooled reflux stream at said top column feed position, with said cooling supplying at least a portion of said heating of said liquefied natural gas.

48. The apparatus according to claim 37 wherein said heat exchange means is further connected to said first pumping means to receive said pumped substantially condensed stream and heat it, said heat exchange means being further connected to said absorber column to supply said heated pumped stream at said mid-column feed position, with said heating supplying at least a portion of said cooling of said vapor distillation stream or said overhead vapor stream.

49. The apparatus according to claim 48 wherein said heat exchange means is further connected to said dividing means to receive said reflux stream and further cool it, said heat exchange means being further connected to said absorber column to supply said further cooled reflux stream at said top column feed position, with said cooling supplying at least a portion of said heating of said liquefied natural gas.

50. The apparatus according to claim 26, 27, 28, or 29 wherein (a) a second heat exchange means is connected to said second dividing means to receive said reflux stream and further cool it, said second heat exchange means being further connected to said fractionation column to supply said further cooled reflux stream at said top column feed position; and (b) said second heat exchange means is further connected to said first expansion means to receive said expanded first stream and heat it, said second heat exchange means being further connected to said fractionation column to supply said heated expanded first stream at said upper mid-column feed position, with said heating supplying at least a portion of said further cooling of said reflux stream.

51. The apparatus according to claim 34 or 35 wherein (a) a second heat exchange means is connected to said second dividing means to receive said reflux stream and further cool it, said second heat exchange means being further connected to said absorber column to supply said further cooled reflux stream at said top column feed position; and (b) said second heat exchange means is further connected to said first expansion means to receive said expanded first stream and heat it, said second heat exchange means being further connected to said absorber column to supply said heated expanded first stream at said first mid-column feed position, with said heating supplying at least a portion of said further cooling of said reflux stream.

52. The apparatus according to claim 34 or 35 wherein (a) a second heat exchange means is connected to said second dividing means to receive said reflux stream and further cool it, said second heat exchange means being further connected to said absorber column to supply said further cooled reflux stream at said top column feed position; and (b) said second heat exchange means is further connected to said first pumping means to receive said pumped substantially condensed stream and heat it, said second heat exchange means being further connected to said absorber column to supply said heated pumped substantially condensed stream at said second mid-column feed position, with said heating supplying at least a portion of said further cooling of said reflux stream.

53. The process according to claim 1, 2, 3, 4, 5, 6, 7, 8, 9, 10, 11, 12, 13, 14, 15, 16, 19, 21, or 22 wherein a major portion of said methane and $C_2$ components is recovered in said volatile liquid fraction and a major portion of $C_3$ components and heavier hydrocarbon components is recovered in said relatively less volatile liquid fraction.

54. The process according to claim 17 wherein a major portion of said methane and $C_2$ components is recovered in said volatile liquid fraction and a major portion of $C_3$ components and heavier hydrocarbon components is recovered in said relatively less volatile liquid fraction.

55. The process according to claim 18 wherein a major portion of said methane and $C_2$ components is recovered in said volatile liquid fraction and a major portion of $C_3$ components and heavier hydrocarbon components is recovered in said relatively less volatile liquid fraction.

56. The process according to claim 20 wherein a major portion of said methane and $C_2$ components is recovered in said volatile liquid fraction and a major portion of $C_3$ components and heavier hydrocarbon components is recovered in said relatively less volatile liquid fraction.

57. The process according to claim 23 wherein a major portion of said methane and $C_2$ components is recovered in said volatile liquid fraction and a major portion of $C_3$ components and heavier hydrocarbon components is recovered in said relatively less volatile liquid fraction.

58. The process according to claim 24 wherein a major portion of said methane and $C_2$ components is recovered in said volatile liquid fraction and a major portion of $C_3$ components and heavier hydrocarbon components is recovered in said relatively less volatile liquid fraction.

59. The process according to claim 25 wherein a major portion of said methane and $C_2$ components is recovered in said volatile liquid fraction and a major portion of $C_3$ components and heavier hydrocarbon components is recovered in said relatively less volatile liquid fraction.

60. The apparatus according to claim 26, 27, 28, 29, 30, 31, 32, 33, 34, 35, 36, 37, 38, 39, 40, 41, 45, 46, 48, or 49 wherein a major portion of said methane and $C_2$ components is recovered in said volatile liquid fraction and a major portion of $C_3$ components and heavier hydrocarbon components is recovered in said relatively less volatile liquid fraction.

61. The apparatus according to claim 42 wherein a major portion of said methane and $C_2$ components is recovered in said volatile liquid fraction and a major portion of $C_3$ components and heavier hydrocarbon components is recovered in said relatively less volatile liquid fraction.

62. The apparatus according to claim 43 wherein a major portion of said methane and $C_2$ components is recovered in said volatile liquid fraction and a major portion of $C_3$ components and heavier hydrocarbon components is recovered in said relatively less volatile liquid fraction.

63. The apparatus according to claim 44 wherein a major portion of said methane and $C_2$ components is recovered in said volatile liquid fraction and a major portion of $C_3$ components and heavier hydrocarbon components is recovered in said relatively less volatile liquid fraction.

64. The apparatus according to claim 47 wherein a major portion of said methane and $C_2$ components is recovered in said volatile liquid fraction and a major portion of $C_3$ components and heavier hydrocarbon components is recovered in said relatively less volatile liquid fraction.

65. The apparatus according to claim 50 wherein a major portion of said methane and $C_2$ components is recovered in said volatile liquid fraction and a major portion of $C_3$ components and heavier hydrocarbon components is recovered in said relatively less volatile liquid fraction.

66. The apparatus according to claim 51 wherein a major portion of said methane and $C_2$ components is recovered in said volatile liquid fraction and a major portion of $C_3$ components and heavier hydrocarbon components is recovered in said relatively less volatile liquid fraction.

67. The apparatus according to claim 52 wherein a major portion of said methane and $C_2$ components is recovered in said volatile liquid fraction and a major portion of $C_3$ components and heavier hydrocarbon components is recovered in said relatively less volatile liquid fraction.

* * * * *

UNITED STATES PATENT AND TRADEMARK OFFICE

CERTIFICATE OF CORRECTION

PATENT NO. : 7,216,507 B2
APPLICATION NO. : 11/144728
DATED : May 15, 2007
INVENTOR(S) : Kyle T. Cuellar et al.

It is certified that error appears in the above-identified patent and that said Letters Patent is hereby corrected as shown below:

ON THE TITLE PAGE [56] REFERENCES CITED:

U.S Patent Documents, "6,014,869 1/2000 Elion et al."
should read --6,014,869 1/2000 Ellon et al.--; and
Other Patents, in "Kikkawa, Yoshitsugi, . . . etc.", "San Antonia," should read --San Antonio,--.

COLUMN 25:

Line 37, "in" should be deleted.

COLUMN 37:

Line 61, "comprising" should read --comprising:--.

COLUMN 38:

Line 56, "comprising" should read --comprising:--.

COLUMN 39:

Line 52, "comprising" should read --comprising:--.

COLUMN 40:

Line 37, "comprising" should read --comprising:--.

COLUMN 41:

Line 24, "comprising" should read --comprising:--.

COLUMN 42:

Line 25, "comprising" should read --comprising:--.

COLUMN 43:

Line 17, "comprising" should read --comprising:--.

UNITED STATES PATENT AND TRADEMARK OFFICE

CERTIFICATE OF CORRECTION

PATENT NO. : 7,216,507 B2
APPLICATION NO. : 11/144728
DATED : May 15, 2007
INVENTOR(S) : Kyle T. Cuellar et al.

It is certified that error appears in the above-identified patent and that said Letters Patent is hereby corrected as shown below:

COLUMN 44:

Line 3, “comprising” should read --comprising:--; and
Line 44, “comprising” should read --comprising:--.

COLUMN 45:

Line 49, “comprising” should read --comprising:--; and
Line 53, “receive” should read --to receive--.

COLUMN 46:

Line 56, “comprising” should read --comprising:--.

COLUMN 47:

Line 51, “comprising” should read --comprising:--.

COLUMN 48:

Line 45, “comprising” should read --comprising:--.

COLUMN 49:

Line 4, “connect” should read --connected--;
Line 48, “comprising” should read --comprising:--; and
Line 65, “connect” should read --connected--.

COLUMN 50:

Line 12, “connect” should read --connected--; and
Line 42, “comprising” should read --comprising:--.

COLUMN 51:

Line 15, “connect” should read --connect--; and
Line 45, “comprising” should read --comprising:--.

UNITED STATES PATENT AND TRADEMARK OFFICE

CERTIFICATE OF CORRECTION

PATENT NO. : 7,216,507 B2
APPLICATION NO. : 11/144728
DATED : May 15, 2007
INVENTOR(S) : Kyle T. Cuellar et al.

It is certified that error appears in the above-identified patent and that said Letters Patent is hereby corrected as shown below:

COLUMN 52:

Line 8, "connect" should read --connected--.

Signed and Sealed this

Sixteenth Day of October, 2007

JON W. DUDAS
*Director of the United States Patent and Trademark Office*